US006179399B1

(12) United States Patent
Brüstle et al.

(10) Patent No.: US 6,179,399 B1
(45) **Date of Patent: *Jan. 30, 2001**

(54) FASTENING DEVICE FOR A DRAWER

(75) Inventors: Klaus Brüstle, Höchst; Helmut Hollenstein, Lustenau, both of (AT)

(73) Assignee: Julius Blum Gesellschaft m.b.H., Höchst (AT)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/033,719

(22) Filed: Mar. 3, 1998

(30) Foreign Application Priority Data

Mar. 3, 1997 (AT) ..... 357/97
Nov. 27, 1997 (AT) ..... 2009/97

(51) Int. Cl.[7] ..... A47B 88/00
(52) U.S. Cl. ..... 312/348.4; 312/263
(58) Field of Search ..... 312/330.1, 348.1, 312/348.2, 348.4, 263; 403/406.1, 407.1

(56) References Cited

U.S. PATENT DOCUMENTS 2,775,501 * 12/1956 Kyllo ..... 312/348.4
4,815,796 3/1989 Röck et al. ..... 312/263
4,874,212 * 10/1989 Rock et al. ..... 312/330.1
5,364,181 * 11/1994 Scheible ..... 312/348.4
5,611,637 * 3/1997 Brustle et al. ..... 312/348.4
5,664,857 * 9/1997 Lautenschlager et al. ..... 312/348.4
5,688,033 * 11/1997 Fleisch et al. ..... 312/348.4

FOREIGN PATENT DOCUMENTS

289866 * 11/1988 (EP) ..... 312/348.4
0 732 069 9/1996 (EP) .
97/16090 5/1997 (WO) .

* cited by examiner

*Primary Examiner*—Peter M. Cuomo
*Assistant Examiner*—James O. Hansen
(74) *Attorney, Agent, or Firm*—Wenderoth, Lind & Ponack, L.L.P.

(57) ABSTRACT

A fastening device enables fastening of a front panel of a drawer to respective metal drawer side walls each having a vertical web having an opening. The fastening device has a fastening member having a holding plate to be attached to the front panel and a fastening device to extend perpendicularly to the drawer front panel. A clamping lever is mounted on the fastening plate by an axle and is tiltable on such axle between a locking position for securing the front panel to the drawer side wall and an unlocking position in which the front panel can be removed from the drawer side wall. A tightening member is slidably mounted on the fastening plate and is moveable by tilting of the clamping lever. The tightening member is provided with a lateral projection to be moved into the opening in the vertical web of the drawer side wall when the clamping lever is tilted into its locking position.

42 Claims, 21 Drawing Sheets

3
8
9
10
11
12
13
14
16
17
21
32

3
8
9
10
11
12
13
14
16
32
34
35
36
37
38
40
42
120
121
122

FASTENING DEVICE FOR A DRAWER

BACKGROUND OF THE INVENTION

The invention relates to a fastening device for fastening a front panel of a drawer to respective metal drawer side walls with vertical webs, each vertical web having an opening, the fastening device being provided with a fastening member having a holding plate to be attached to the front panel and a fastening plate to extend perpendicularly to the drawer front panel.

Such a fastening device is shown in AT 387 316 B and provides rapid anchoring of the front panel on he drawer side walls, whereby it is still possible to adjust the position of the front panel with respect to the drawer side walls.

SUMMARY OF THE INVENTION

The object of the invention is to provide a fastening device which makes mounting of a front panel of a drawer on the side walls possible without the use of a tool and which can be locked on the drawer side walls very quickly.

This object is achieved according to the invention in that a clamping lever is mounted on the fastening plate by means of an axle and is tiltable on such axle between a locking position for securing the front panel to the drawer side wall and an unlocking position in which the front panel can be removed from the drawer side wall, a tightening member which is slideably mounted on the fastening plate, is moveable by tilting of the clamping lever, and is provided with a lateral projection that is moved into the opening in the vertical web of the drawer side wall when the clamping lever is tilted into its locking position.

It is a further object of the invention to provide a front panel fastening means which can be locked on the drawer side wall only when the fastening means is properly mounted on the drawer side wall.

To achieve this object of the invention the clamping lever is provided with at least one stop which prevents tilting of the clamping lever into the locking position when the fastening device is not mounted correctly on the drawer side wall.

BRIEF DESCRIPTION OF THE DRAWINGS

The various embodiment of the invention are described below with reference to the accompanying drawings, in which.

DETAILED DESCRIPTION OF THE INVENTION

Figure 1:
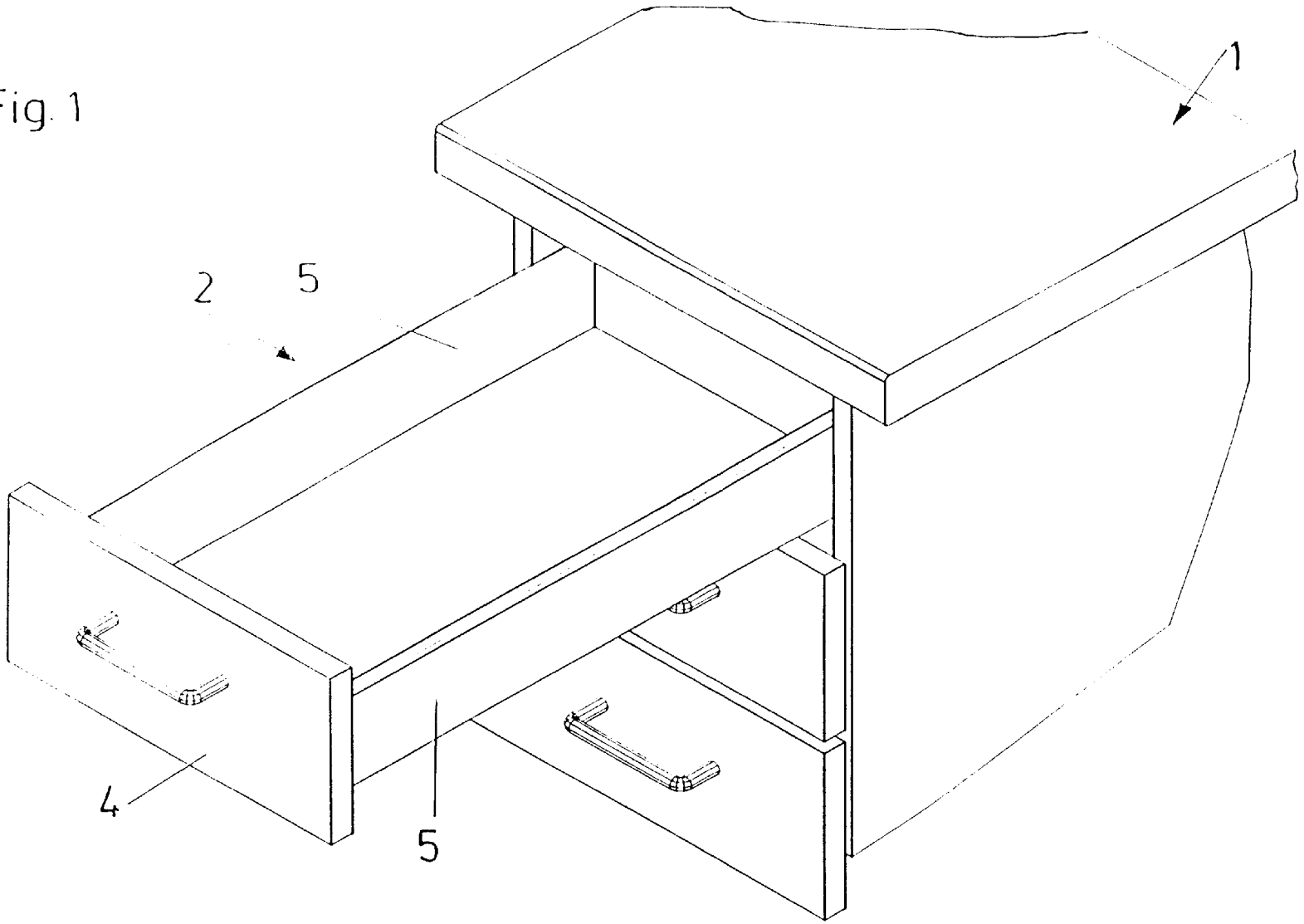
FIG. 1 is a perspective view of a cabinet with drawers.
Figure 2:
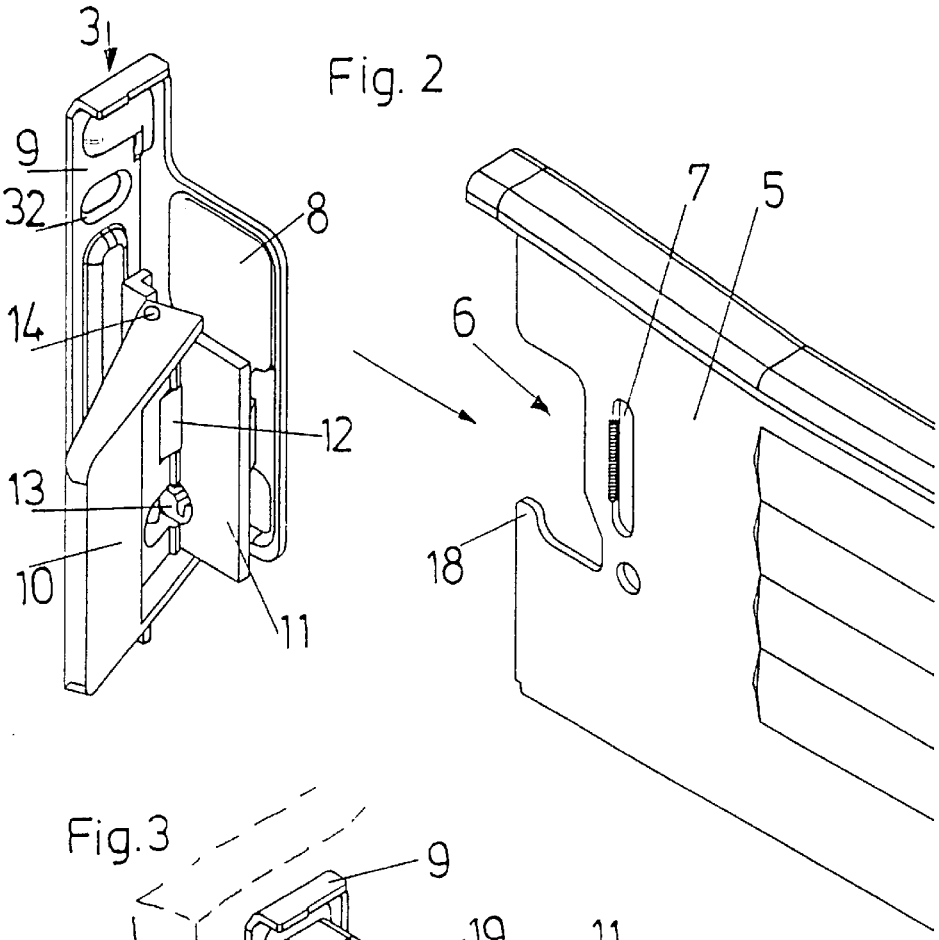
FIG. 2 is a perspective view of the front end of a drawer side wall and a fastening device shown separated.
Figure 3:
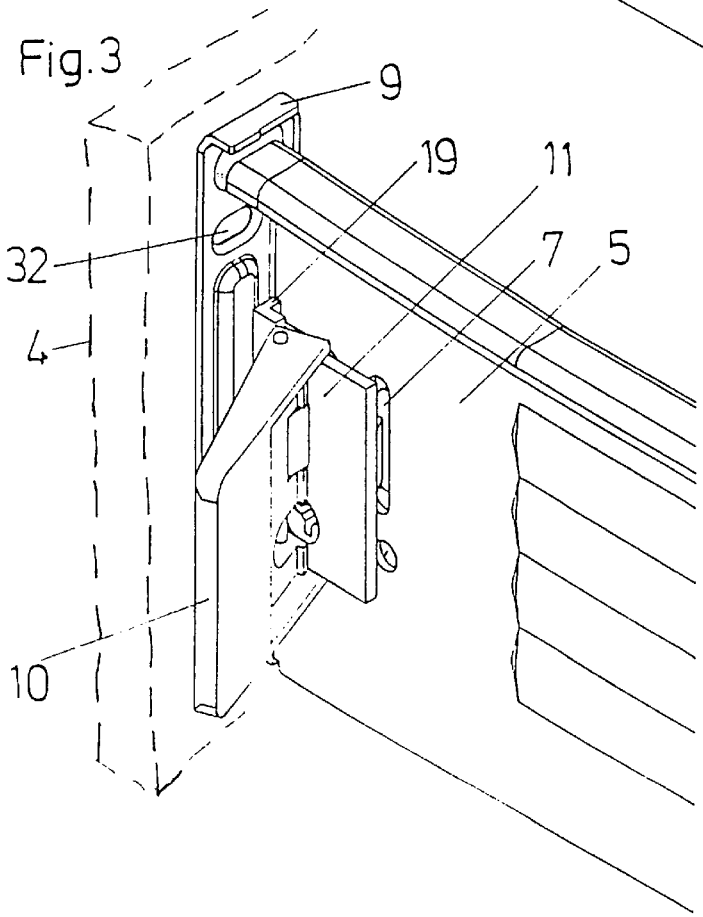
FIG. 3 is a perspective view of the front end of a drawer side wall and a fastening device whereby the fastening device is mounted on the drawer side wall but is not locked to the drawer side wall.
Figure 5:
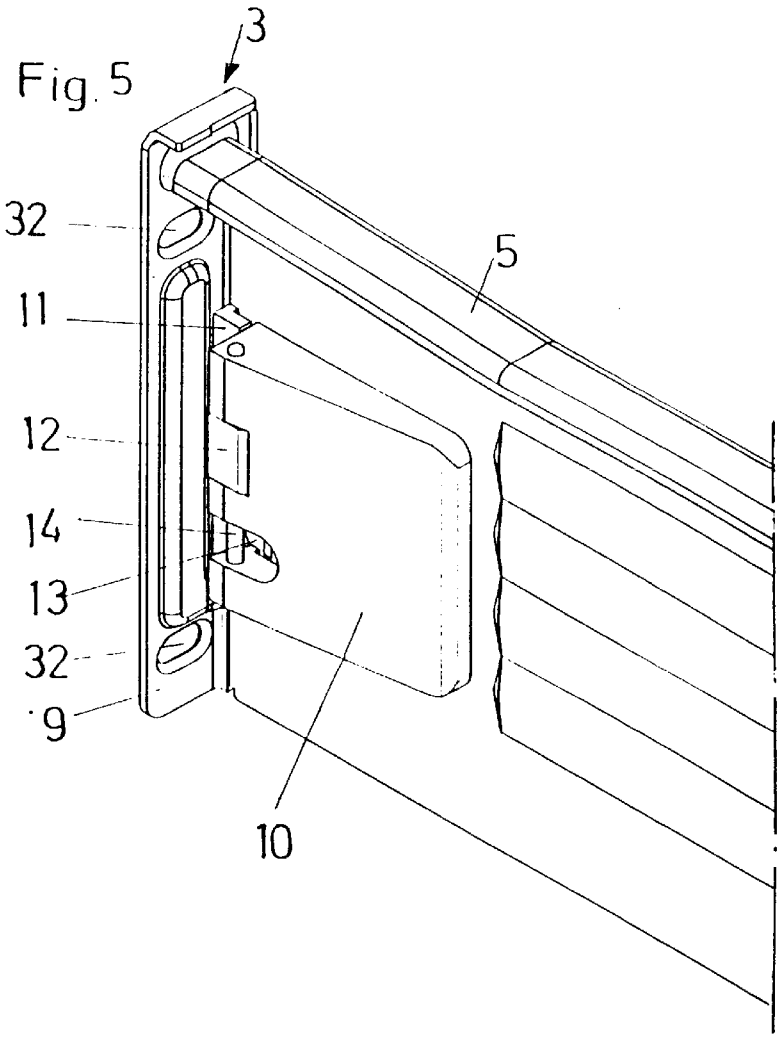
FIG. 5 is perspective view of the front end of a drawer side wall with the fastening device in the locking position.
Figure 4:
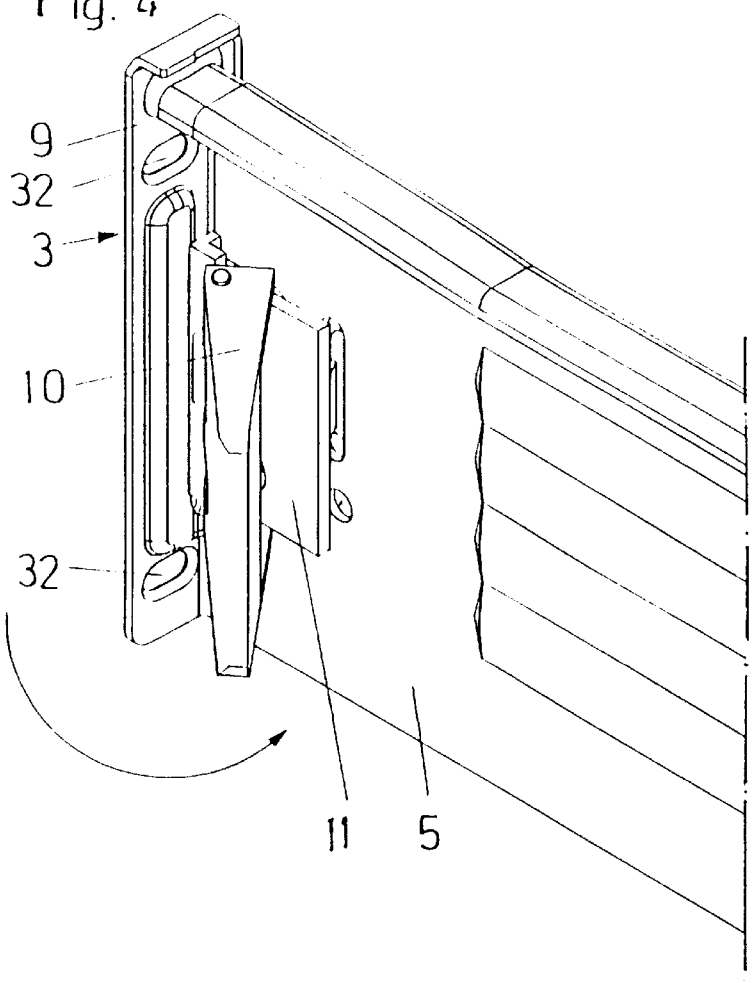
FIG. 4 is a perspective view of the front end of the drawer side wall with a mounted fastening whereby a clamping lever is partially moved into a locking position.
Figure 8:
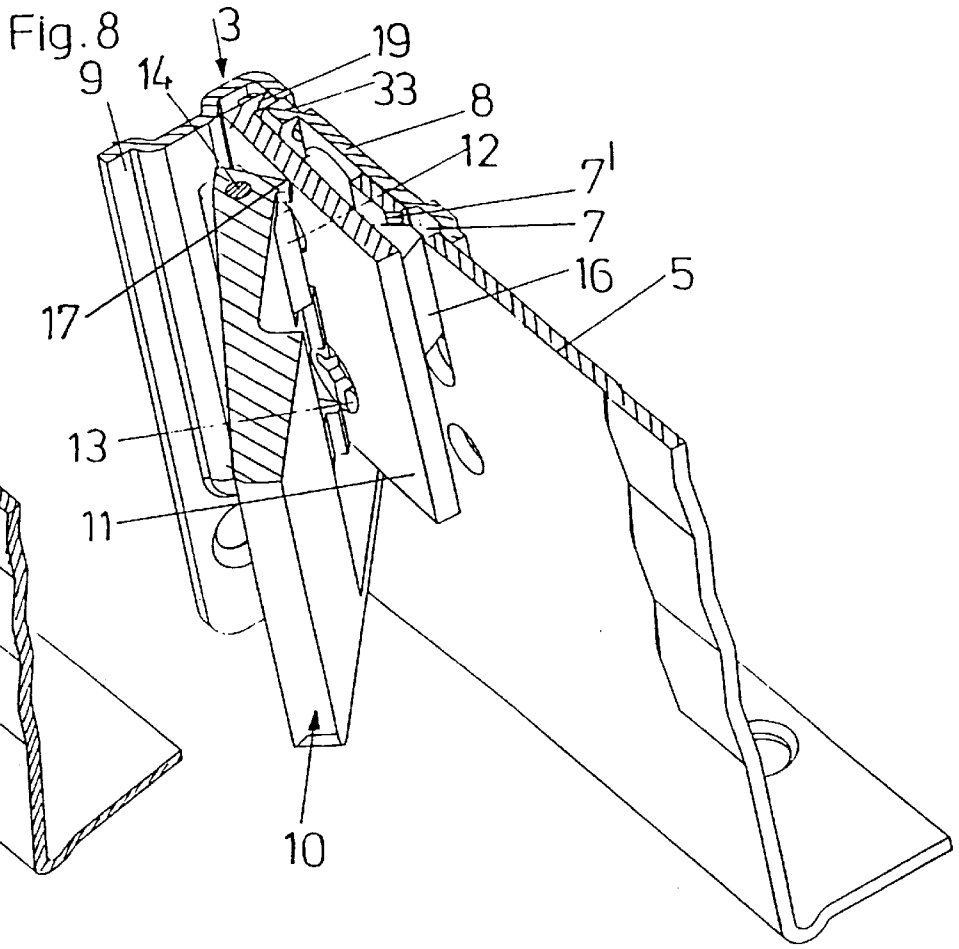
FIG. 8 is the same sectional view as FIG. 7, whereby the clamping lever is shown in a position before the locking position.
Figure 7:
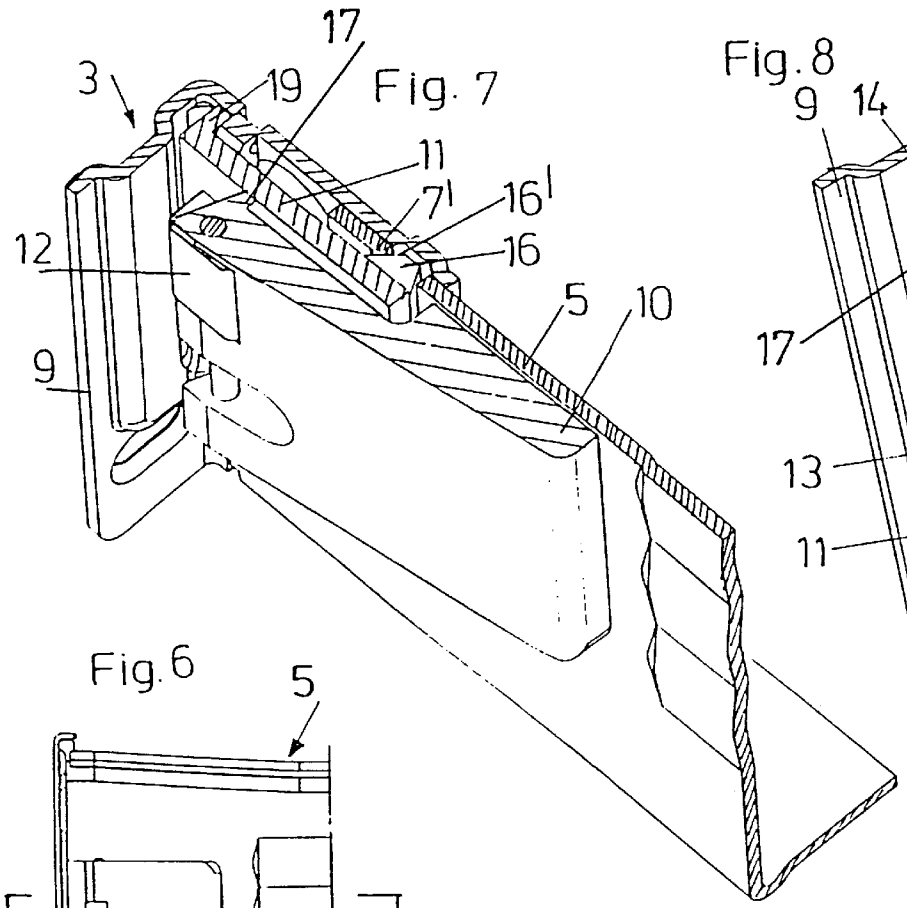
FIG. 7 a sectional view taken along line VII—VII of FIG. 6, whereby the clamping lever is in the locking position.
Figure 6:
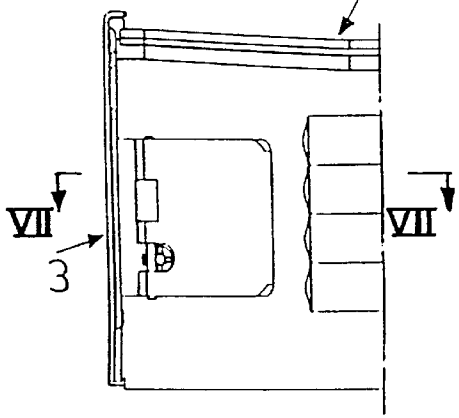
FIG. 6 is a side view of the front end of a drawer side wall.
Figure 9B:
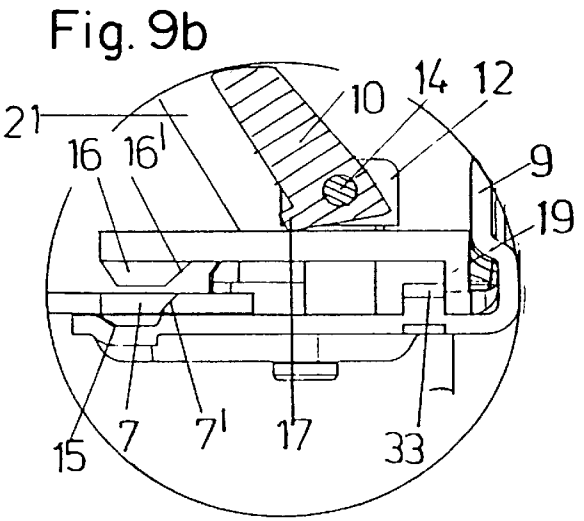
FIGS. 9*a* to 11*b* are horizontal sectional views and respective enlarged details of the front end of a drawer side wall and the fastening device, whereby the fastening device is shown in a removable position, an intermediate position and the locking position.
Figure 9A:
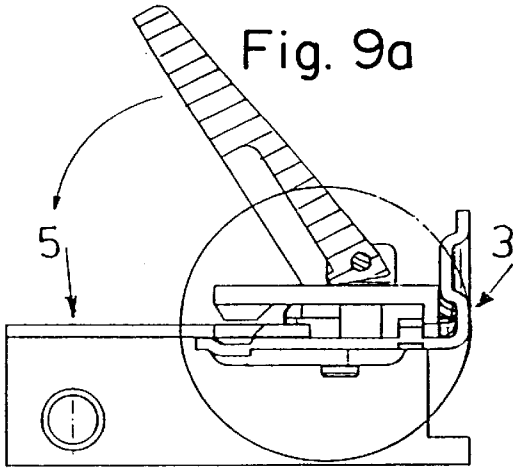
Figure 10B:
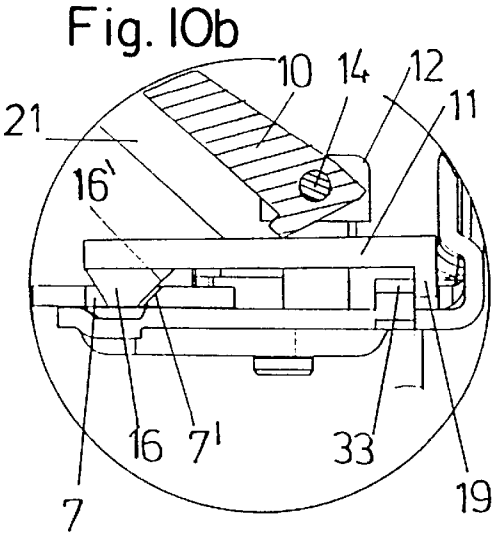
Figure 10A:
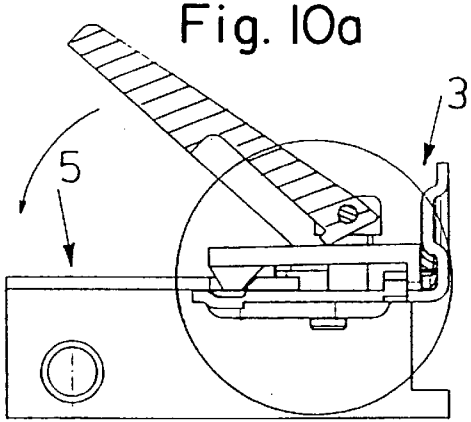
Figure 11B:
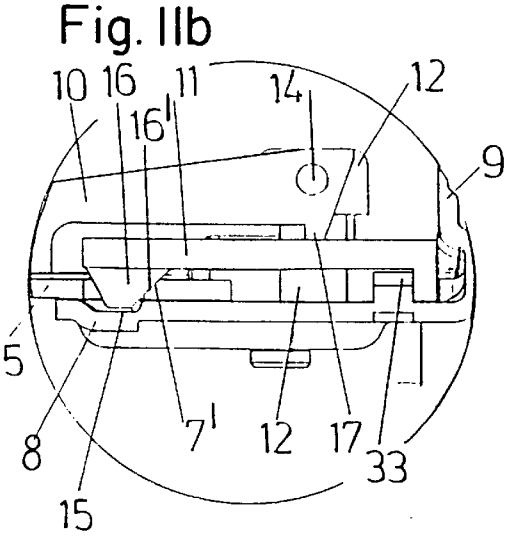
Figure 11A:
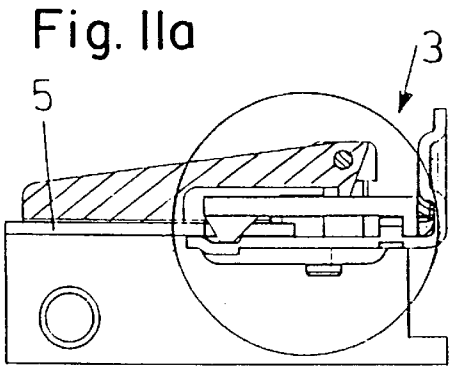
Figures 12, 13, 14:
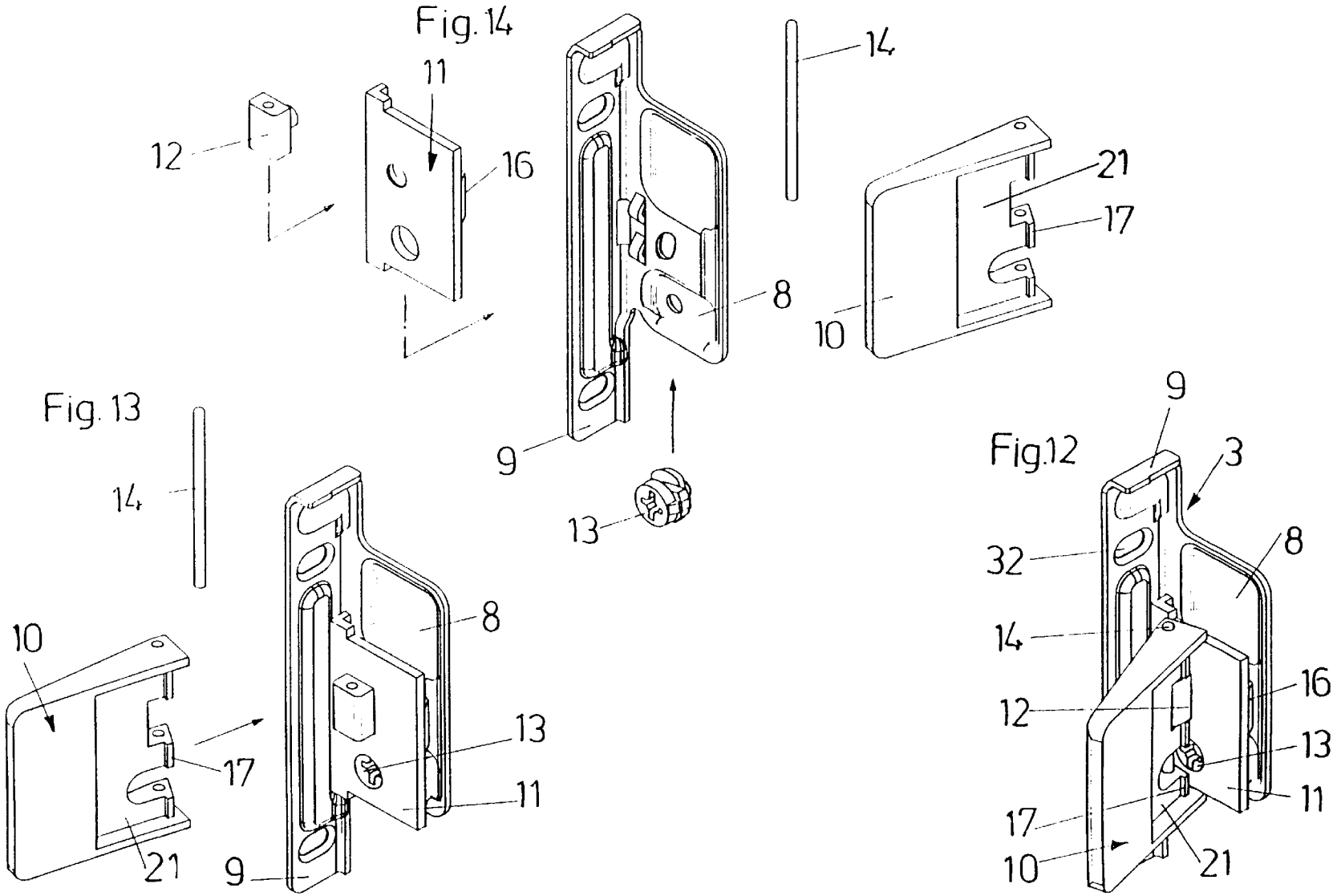
FIG. 12 is a perspective view of the fastening device whereby the clamping lever is shown in a non-locking position.
FIG. 13 is an exploded perspective view of the fastening device whereby the clamping lever is removed.
FIG. 14 is an exploded perspective view of the fastening device in which the parts are shown separated.
Figure 15:
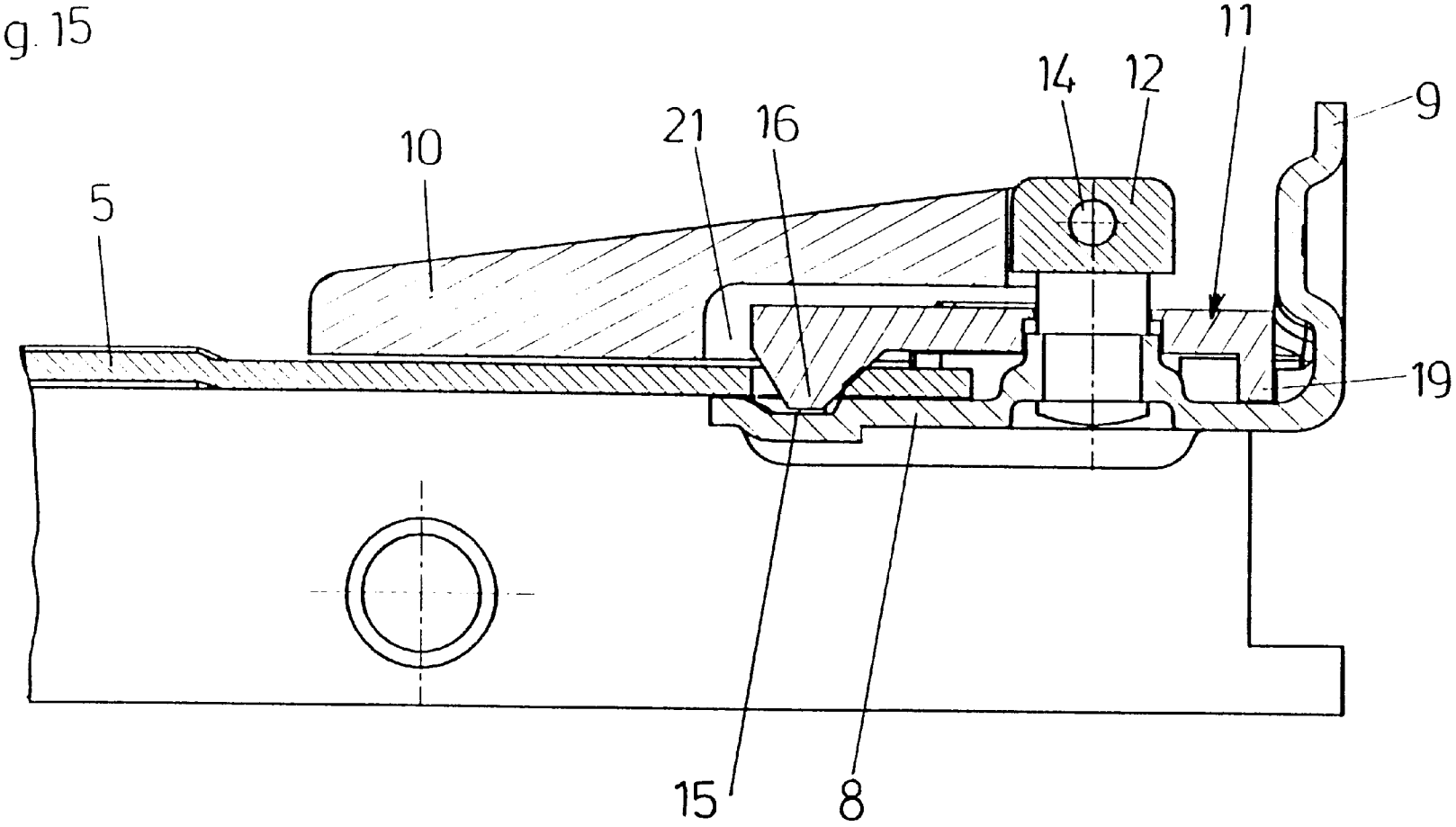
FIG. 15 is a horizontal sectional view of the front end of a drawer side wall and the fastening device, whereby the fastening device is shown in the locking position.

A cabinet 1 is provided with drawers 2. Front panels 4 of the drawers 2 are fastened to drawer side walls 5 by means of fastening devices 3. The drawer side walls 5 are made of metal, preferably steel, and are at their other upper rims provided with running flange for rollers mounted on the side walls of the cabinet 1. At the rear end the drawer side walls 5 are also provided with rollers, each of which, when the drawer 2 is inserted into the cabinet 1, rests on a flange of a corresponding support rail fastened to the cabinet side wall. The bottom panel and the upper wall of each drawer 2 are fastened to the drawer side walls 5 in any conventional manner.

Each drawer side wall 5 is at its front end provided with a cut-out 6. Each cut-out 6 is provided at its lower rim with an upwardly protruding nose 18 so that the fastening device 3 can be hooked onto nose 18 and thereby be anchored to the drawer side wall 5. Anchoring of the front panel 4 to the drawer side wall 5 can be effected by means of an eccentric 13 mounted in the fastening device 3 by means of which the position of the front panel 4 can be adjusted in a vertical direction with respect to the drawer side wall 5. When the fastening device 3 which is mounted on the front panel 4 is hooked onto the nose 18 and is thereby anchored to the drawer side wall 5, the position of the front panel 4 is still adjustable. Final fixing of the front panel 4 to the drawer side wall 5 is achieved by locking the fastening device 3 on the drawer side wall 5. Behind the cut-out 6 is provided a vertical opening 7 in the form of a slot into which a lateral projection 16 of a tightening member 11 protrudes.

The fastening device 3 is provided with a holding plate 9 extending parallel to the front panel 4 and which can be screwed to the front panel 4 or fastened thereto by means of dowels. The fastening device 3 is further provided with a fastening plate 8 extending perpendicularly to the front panel 4. The holding plate 9 is provided with horizontal slots 32 which make adjustment of the front panel 4 with respect to the sides of the drawer 2 possible. A clamping lever 10 is mounted on the fastening plate 8 by means of a holding member 12 and a pin 14 about which the clamping lever 10 is tiltably mounted. The holding member 12 is riveted into the fastening plate 8.

Tightening member 11 in the form of a plate is positioned between the clamping lever 10 and the fastening plate 8. The tightening member 11 is provided with a flange 19 which is slidably held between the holding plate 9 and shoulder 33 of the fastening plate 8. The tightening member 11 is moved in a direction parallel to the front panel 4 by tilting the clamping lever 10. The clamping lever 10, which is mounted on pin 14, is provided with a lateral projection 17 which abuts the tightening member 11 and pushes the tightening member 11 into a locking position. The clamping lever 10 is in the form of a cap covering the tightening member 11 when in the locking position. The holding member 12 projects through a hole in the tightening member 11 and also acts as a guiding member for the tightening member 11 when the clamping lever 10 is moved between an unlocking position and the locking position. Lateral projection 16 of the tightening member 11 has a lateral wedge face 16' abutting a corresponding wedge face 7' of the vertical slot or opening 7. By means of the corresponding wedge faces 7', 16' the tightening member 11 and thereby the fastening device 3 and the front panel 4 are drawn towards the drawer side wall 5. The fastening plate 8 is provided with a recess 15 into which protrudes the projection 16 of the tightening member 11 when the clamping lever 10 is in the locked position.

In the embodiment of FIGS. 16 to 28 lateral projection 26 of tightening member 20 has the form of a hook. Also in this embodiment the lateral projection 26 projects into the vertical opening 7 in the form of a slot in the drawer side wall 5. In this embodiment the front panel 4 is not pulled towards the side wall 5 by means of wedge surfaces but by relative movement of the tightening member 20 with respect to the fastening plate 8. Fastening plate 8 has an outer wall 8' and an inner wall 8" whereby the vertical web of the drawer side wall 5 is held between walls 8', 8" when the fastening device 3 is mounted on the drawer side wall 5. Projections 22 on the inner wall 8" have levers 23 mounted thereon by means of pins 24. The levers 23 are connected to clamping lever 10 by means of pins 25. The clamping lever 10 is connected to the tightening member 20 by means of a pin 14. The pin 14 is held in a slot 27 in a block 28. The block 28 is part of the inner wall 8" of the fastening plate 8. The slot 27 is aligned perpendicularly to the holding plate 9 and therefore to the front panel 4. The tightening member 20 is mounted on the block 28 by means of the pin 14 and a second pin 29 which protrudes into a slot 30 of the block 28. The slot 30 is inclined to the front panel 4 and to the drawer side wall 5. At its front end the slot 30 is provided with portion 31 which is aligned with the slot 27 and therefore is perpendicular to the front panel 4.

Figure 17:
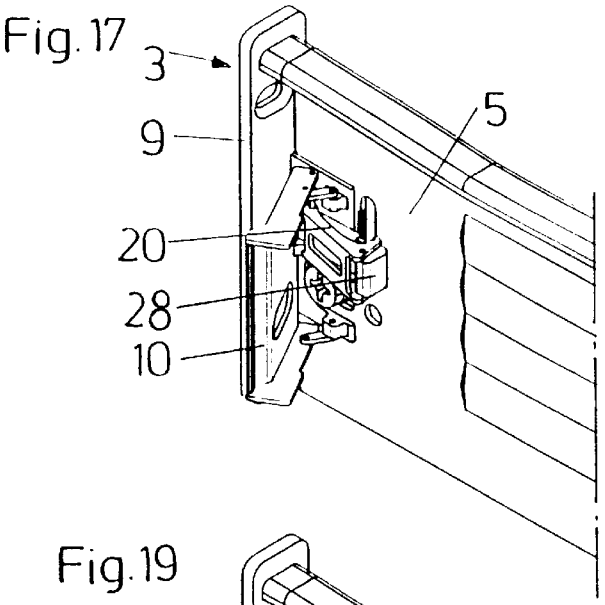
FIGS. 16 to 19 are perspective views of the front ends of a drawer side wall and a further embodiment of the fastening device, whereby the fastening device is shown in different positions of mounting and demounting the front panel.
Figure 19:
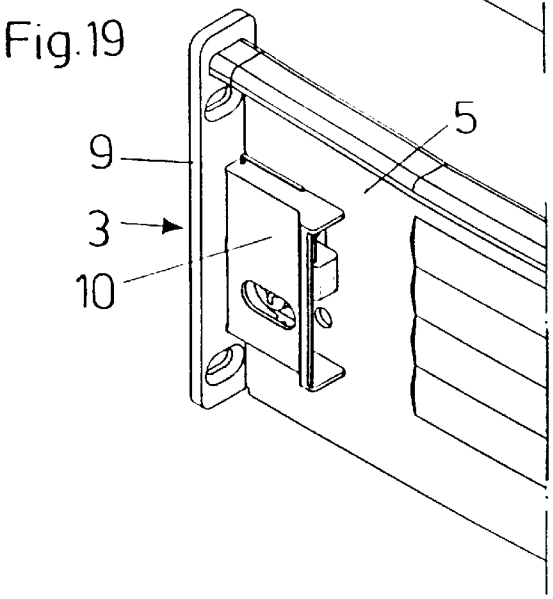
Figure 16:
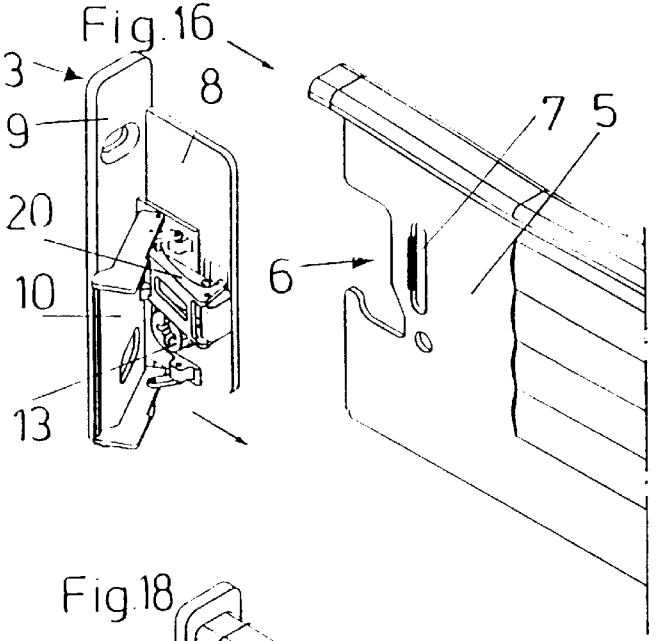
Figure 18:
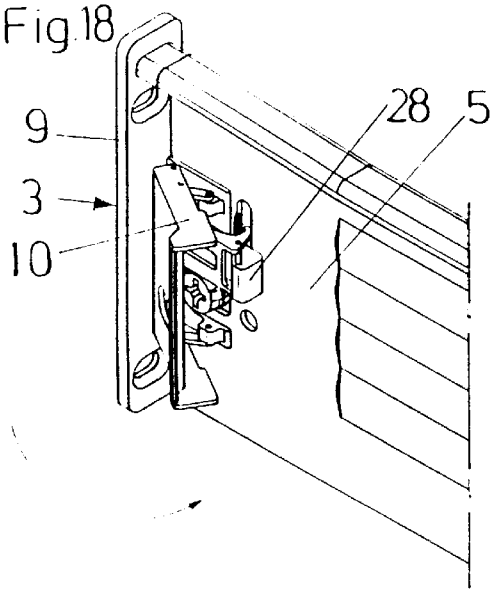
Figure 21:
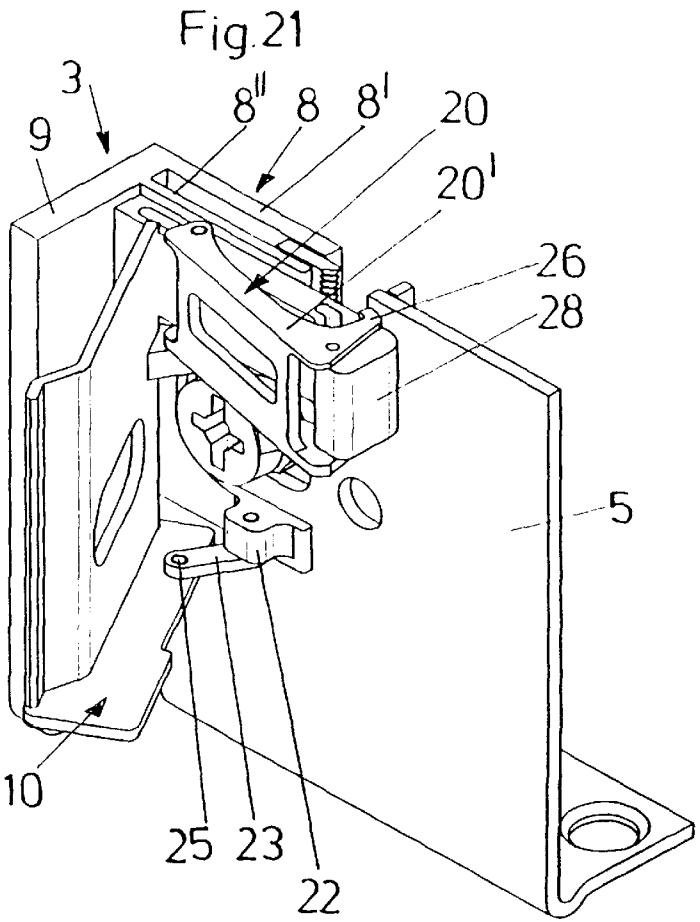
FIG. 21 is a perspective view corresponding to the view of FIG. 20.
Figure 20:
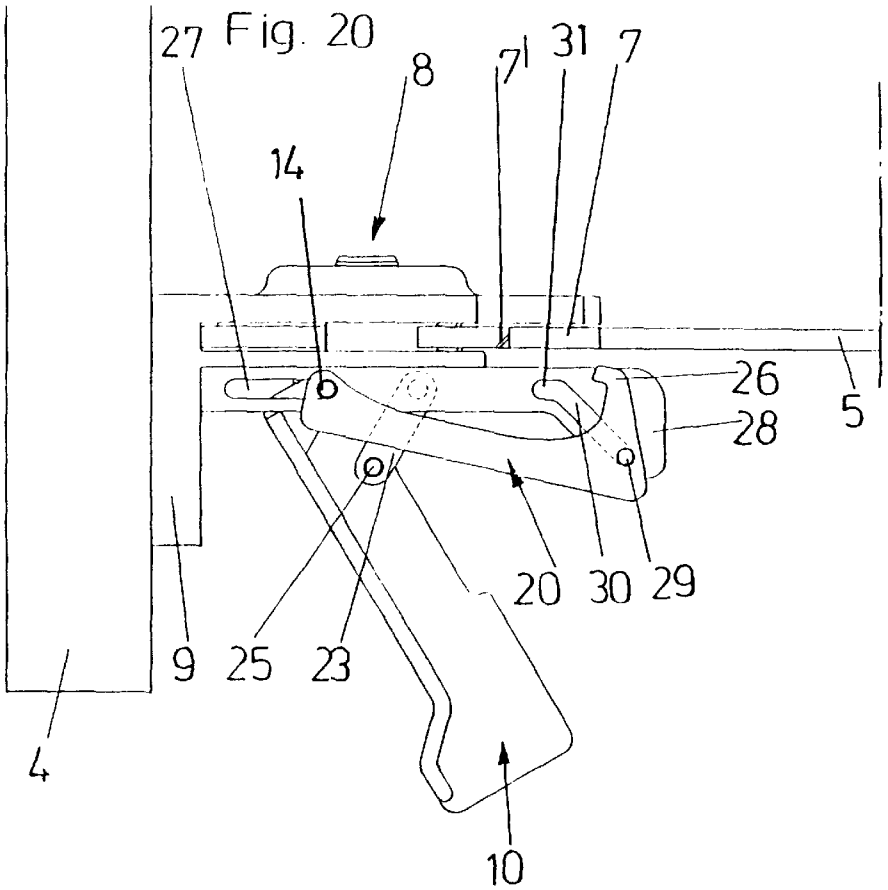
FIG. 20 is a plan view of the fastening device and a horizontal sectional view of the front end of a drawer side wall, whereby the fastening device is shown in the non locking position.
Figure 23:
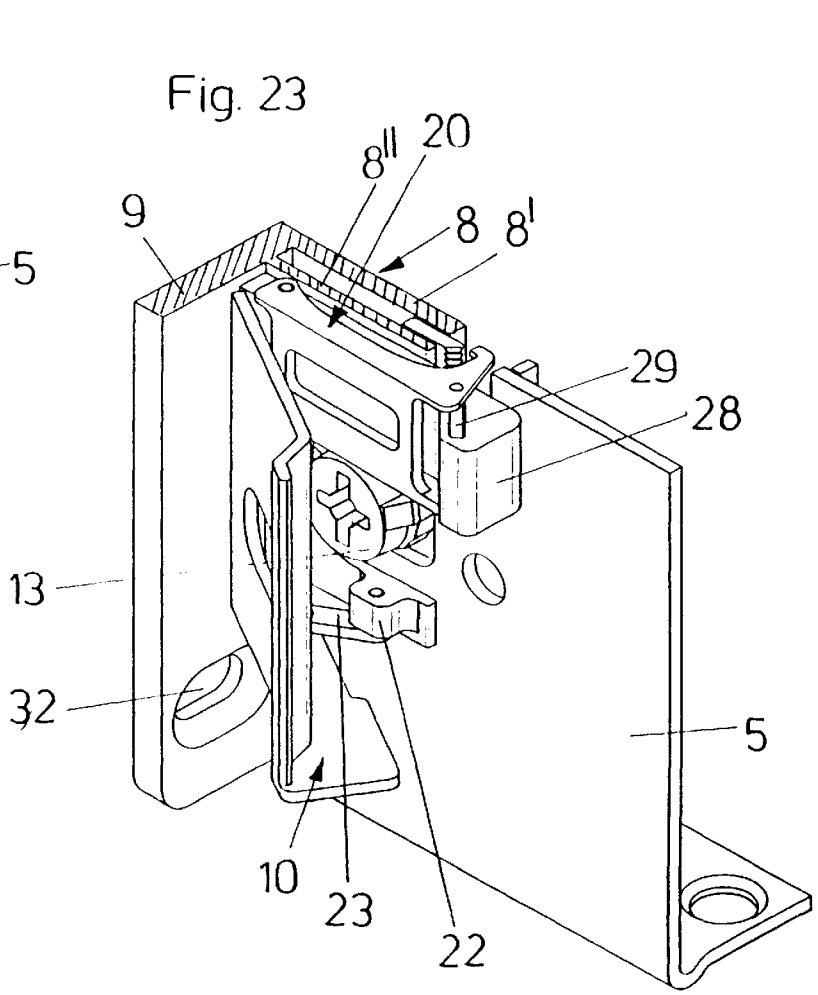
FIG. 23 is perspective view corresponding to the view of FIG. 22.
Figure 22:
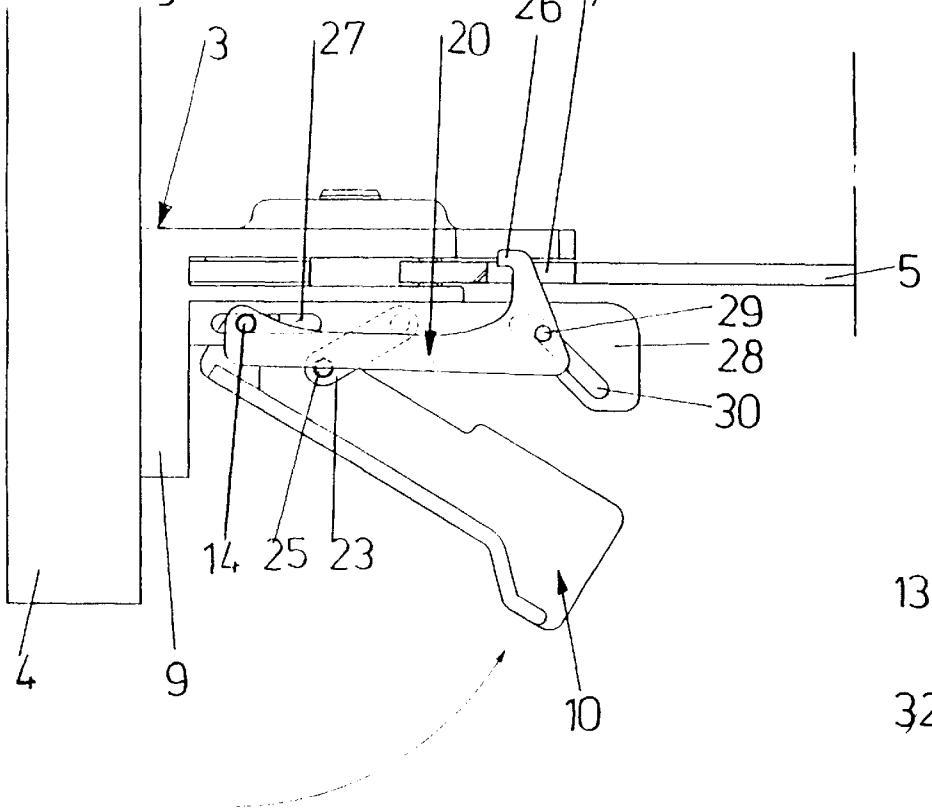
FIG. 22 is the same view as FIG. 20, whereby the clamping lever and the tightening member of the fastening device are shown in an intermediate position.
Figure 25:
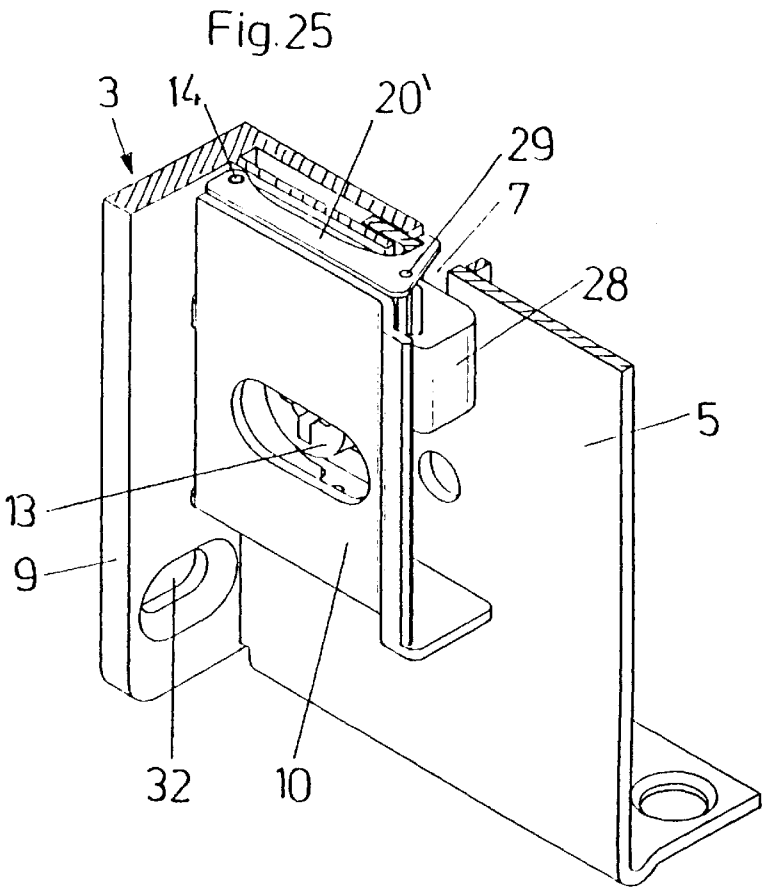
FIG. 25 is a perspective view corresponding to the view of FIG. 24.
Figure 24:
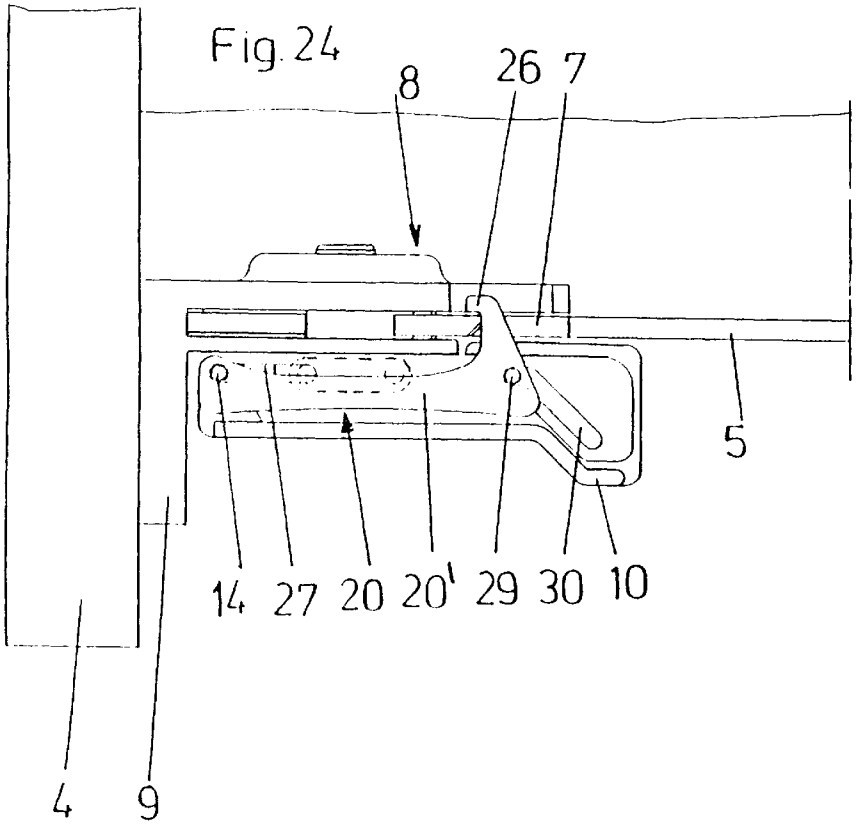
FIG. 24 is the same view as shown in FIGS. 20 and 22, whereby the fastening device is shown in the locking position.
Figure 26:
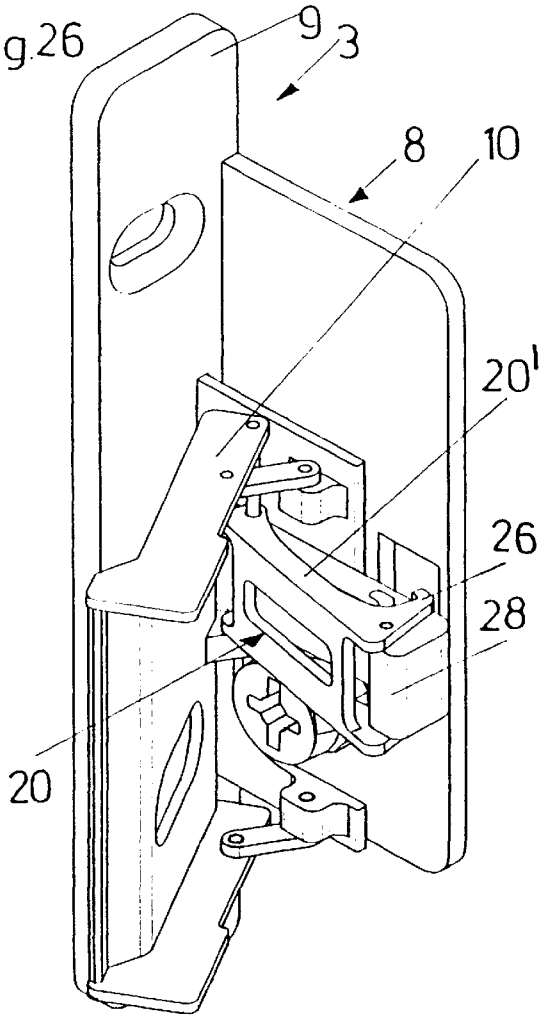
FIG. 26 is a perspective view of the fastening device in the non-locking position.
Figure 27:
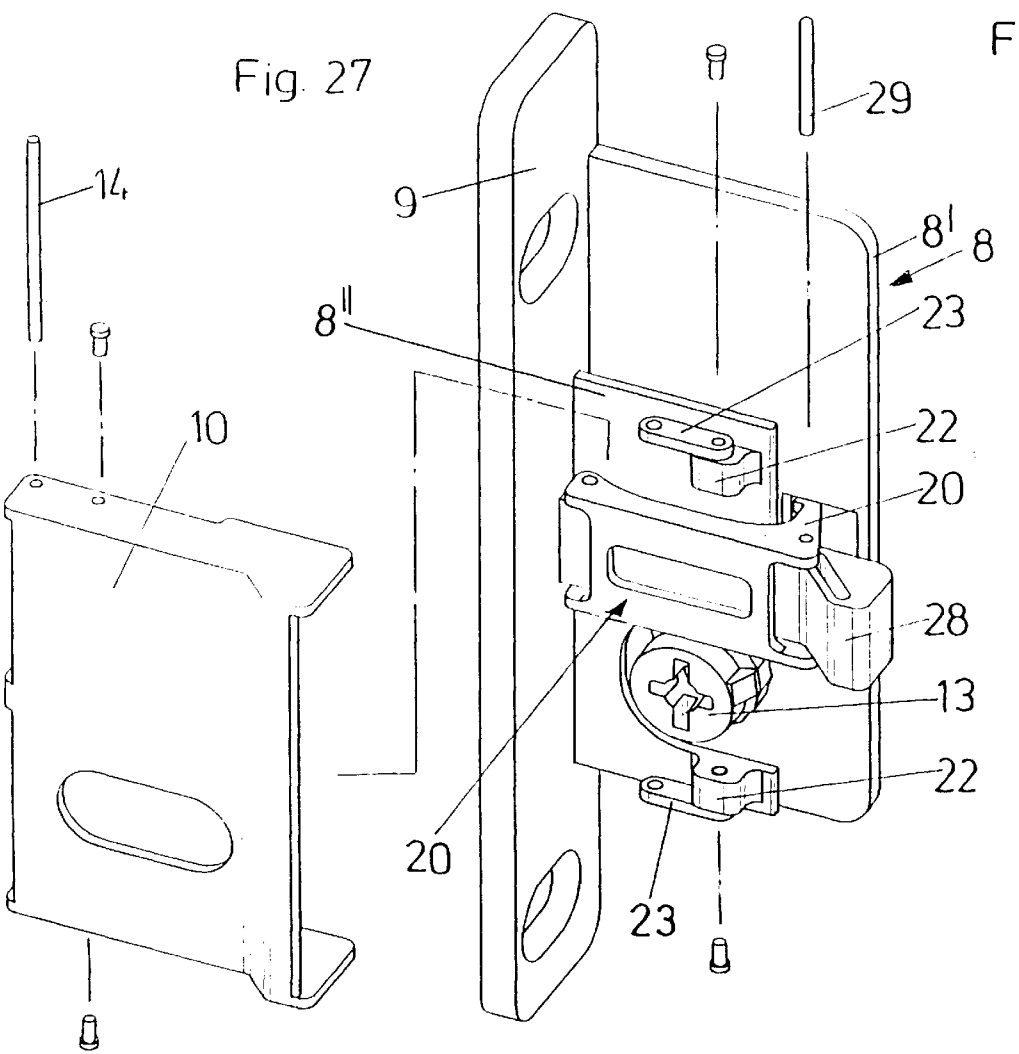
FIG. 27 is a perspective view of the fastening device with the clamping lever removed.
Figure 28:
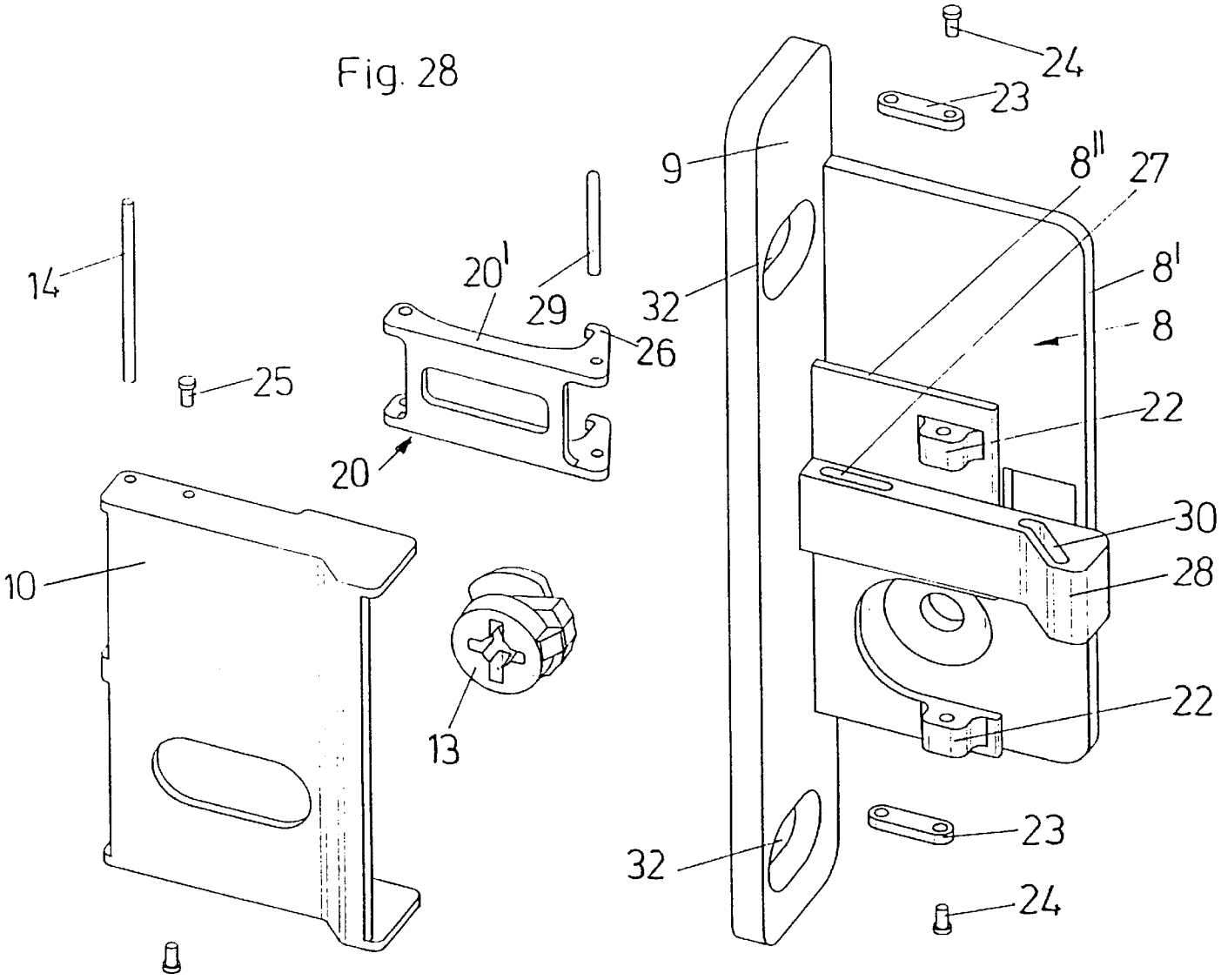
FIG. 28 is a perspective view of the fastening device in which the parts are shown separated.
Figure 30:
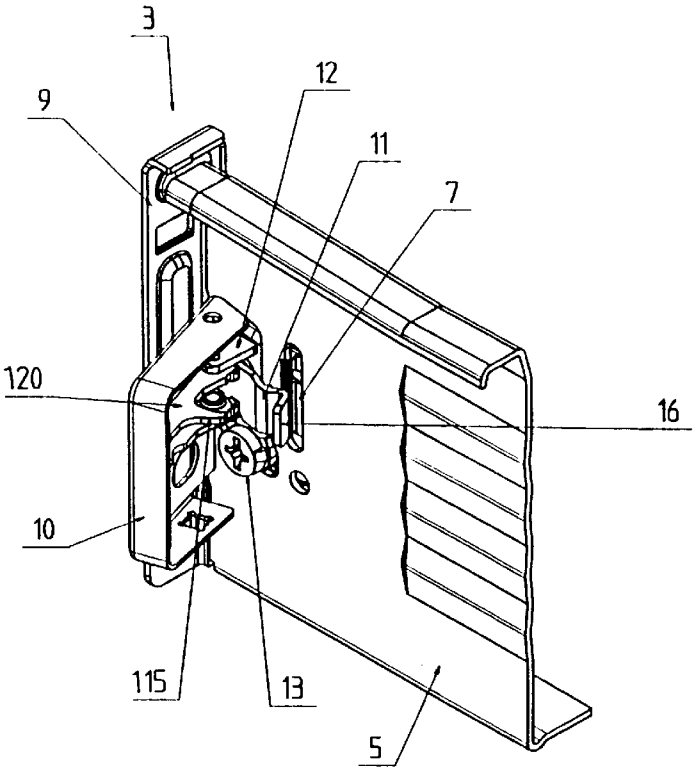
FIG. 30 is a perspective view of the front end of a drawer side wall, whereby the fastening device is mounted on the drawer side wall but is not locked on the drawer side wall.
Figure 29:
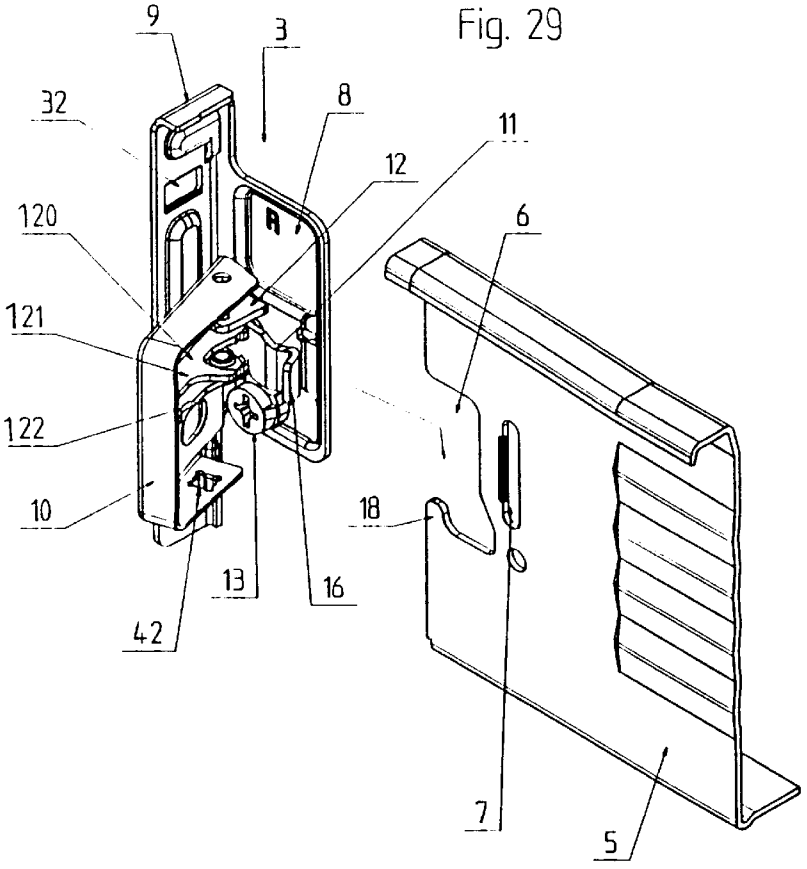
FIG. 29 is a perspective view of the front of a drawer side wall and a fastening device according to a further embodiment of the invention.
Figure 32:
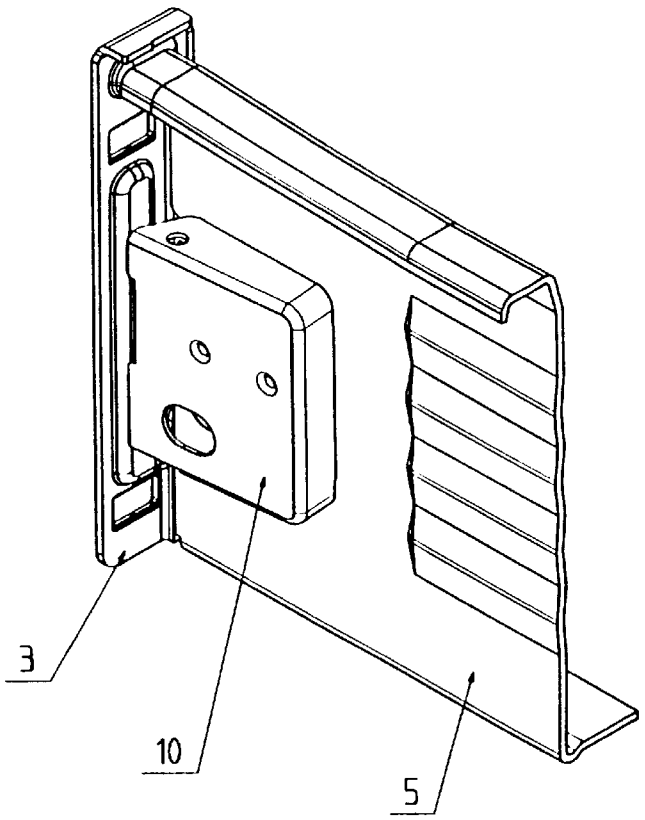
FIG. 32 is a view of the front end of a drawer side wall with a fastening device in the locking position.
Figure 31:
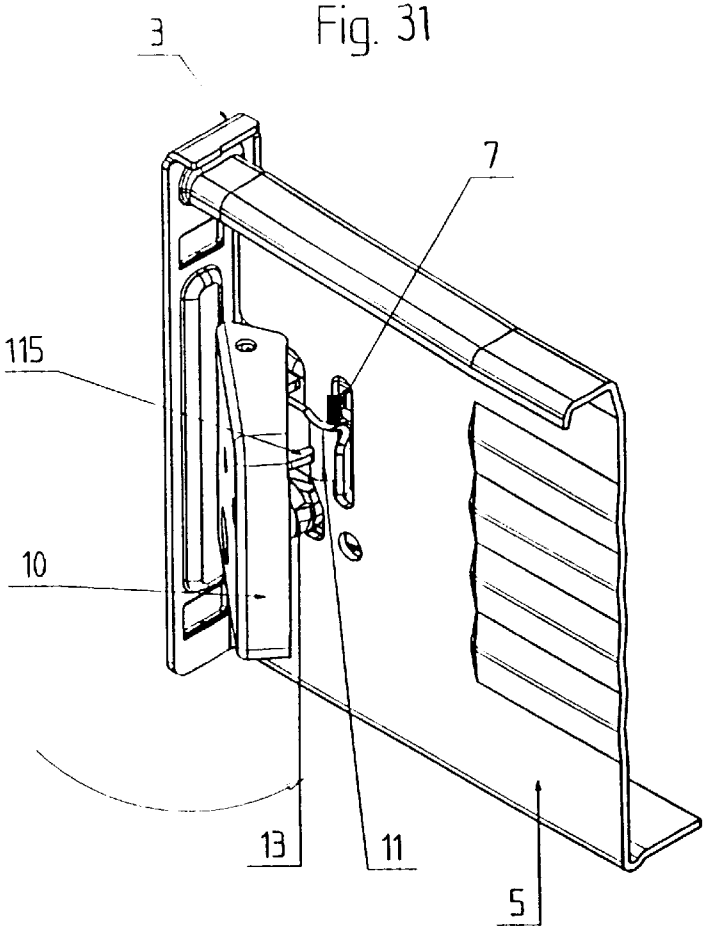
FIG. 31 is a view of the front end of a drawer side wall with the fastening device being mounted on the drawer side wall but the clamping lever being only partially tilted.

Mounting of the fastening device 3 on the drawer side wall 5 is shown in FIGS. 16 to 19. First, the fastening device 3 is screwed to the front panel 4. Then, the fastening device 3 is mounted on the front end of the drawer side wall 5 whereby the eccentric 13 is situated within the cut-out 6 behind the nose 18. Thereafter the clamping lever 10 is tilted counterclockwise as shown in FIG. 17 and 18. By this tilting movement of the clamping lever 10, the tightening member 20 is moved towards the drawer side wall 5 and lateral projection 26 in the form of a hook is moved through the slot or vertical opening 7 in the drawer side wall 5. Further tilting of the clamping lever 10 results in a linear movement of the tightening member 20 with respect to the fastening plate 8 and holding plate 9. The lateral projection 26 of the tightening member 20 abuts the edge 7' of the opening 7, and the fastening plate 8 and the holding plate 9 and therefore the front panel 4 are drawn towards the drawer side wall 5. In the final position, the clamping lever 10 is parallel to the drawer side wall 5, and the pin 29 rests in the portion 31 of the slot 30 so that the clamping lever 10 cannot move by itself from the locking position. The tightening member 20 has a U-shaped profile and embraces the block 28 with its flanges 20', such that stable positioning of the tightening member 20 on the block 28 is obtained.

The holding member 12 has the form of a stirrup with two side flanges projecting through slots 35 in the fastening plate 8. The side flanges are connected to the clamping lever 10 by means of the pin 14. At its middle flange the holding member 12 is provided with a cylindrical protrusion 40 which projects into a hole 36 in the fastening plate 8. The protrusion 40 can be riveted into the fastening plate 8.

Because of the use of a separate holding member 12 it is possible to connect different clamping levers 10 and tightening members 11 to the fastening plate 8. A tightening member 11 in the form of a plate or a yoke is positioned between the clamping lever 10 and the fastening plate 8. The tightening member 11 is preferably made of spring steel.

The tightening member 11 of FIGS. 29–44 is at one end provided with a web 19 having two guide webs 34 by which the tightening member 11 is guided with respect to the fastening plate 8. The guide webs 34 protrude through slots 37 in the fastening plate 8. The tightening member 11 is moved linearly by tilting the clamping lever 10. The clamping lever 10 which is mounted on the fastening plate 8 by means of the pin 14 and the holding member 12 is provided with two cams 38 which press on the tightening member 11 and shift the tightening member 11 when the clamping lever 10 is tilted. These cams 38 are moved over a dead center position when the clamping lever 10 is tilted.

Figure 40:
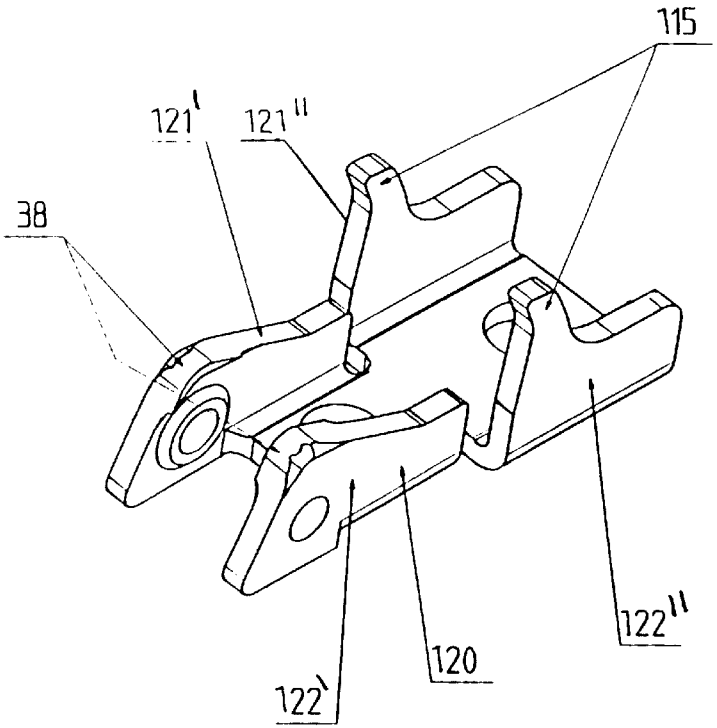
FIG. 40 is a perspective view of a control member.
Figure 44:
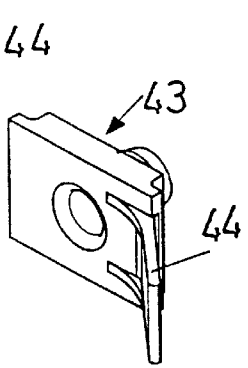
FIG. 44 is a perspective view of the spring element.
Figure 42B:
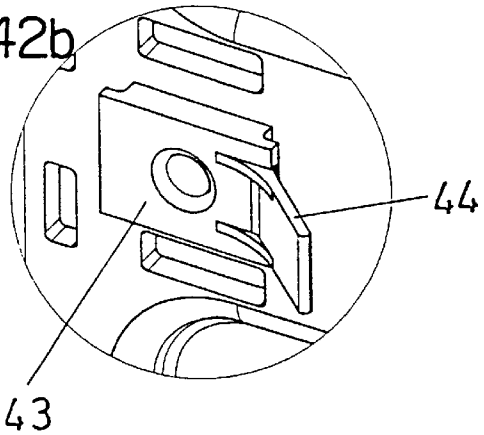
FIGS. 42*a* and 42*b* are a perspective view and an enlarged detail of plates of the fastening device with a spring element.
Figure 42A:
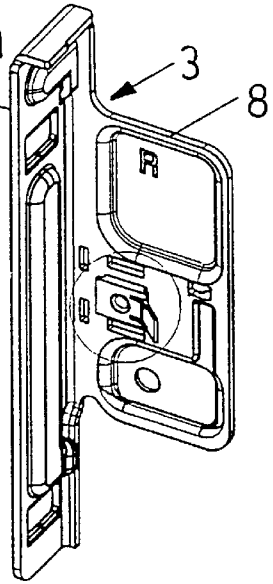
Figure 43B:
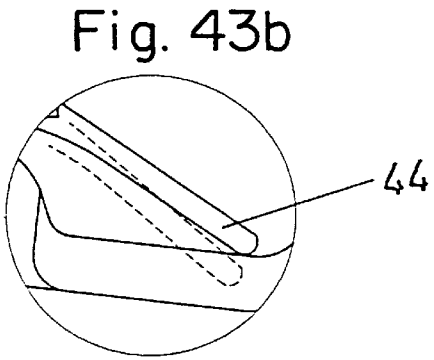
FIGS. 43*a* and 43*b* are a plan view and an enlarged detail of the fastening device with a spring element.
Figure 43A:
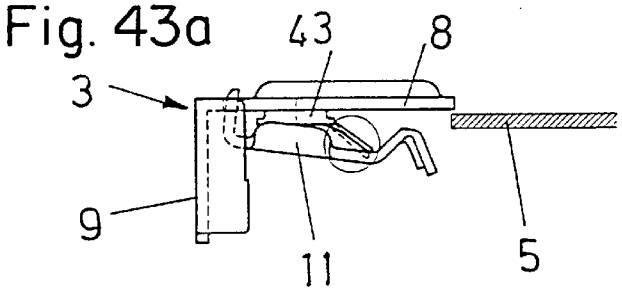

Because of lateral projection 16 in the form of a wedge the fastening device 3 together with the front panel 4 is moved towards the drawer side wall 5 and pressed to the front end of the side wall 5. Control member 120 with a U-shaped profile is mounted on the clamping lever 10. The control member 120 can be riveted to the clamping lever 10. The control member 120 has two lateral webs 121, 122. Each of the lateral webs 121, 122 is provided with a cam 38. In the embodiment shown in FIGS. 29 to 37 only the lateral web 121 is provided with a stop 115. The stop 115 has the form of a hook. It is possible that 20 both lateral webs 121, 122 at the control member 120 are provided with stops 115 as shown in FIG. 40. These stops 115 are situated above and underneath the tightening member 11.

When the fastening device 3 is in a correct position with respect to the drawer side wall 5 and the clamping lever 10 is tilted into the locking position, the cam 38 of the control member 20 pushes the lateral projection 16 of the tightening member 11 into the opening 7 in the drawer side wall 5. Simultaneously, the stop 115 in the form of a hook is moved into the same opening 7 of the drawer side wall 5. In the locking position of the clamping lever 10 and the tightening member 11, the stop 115 is spaced from the front rim of the opening 7. Because of the hook shape of the stop 115, the front panel 4 cannot be removed from the drawer side wall by force when the fastening device 3 is in the locked position. The use of excessive force could happen for example when the drawer 2 is jammed in the cabinet 1. The fastening device 3 can be moved relative to the drawer side wall 5 against the force of the tightening member 11 until the stop 115 abuts the edge of the opening 7. In this way the fastening device acts as a shock absorber when the drawer 2 is slammed into the cabinet 1 and the front panel 4 hits the side walls of the cabinet. Advantageously, the tip of the stop 115 protrudes into a recess in the fastening plate 8.

Figure 38:
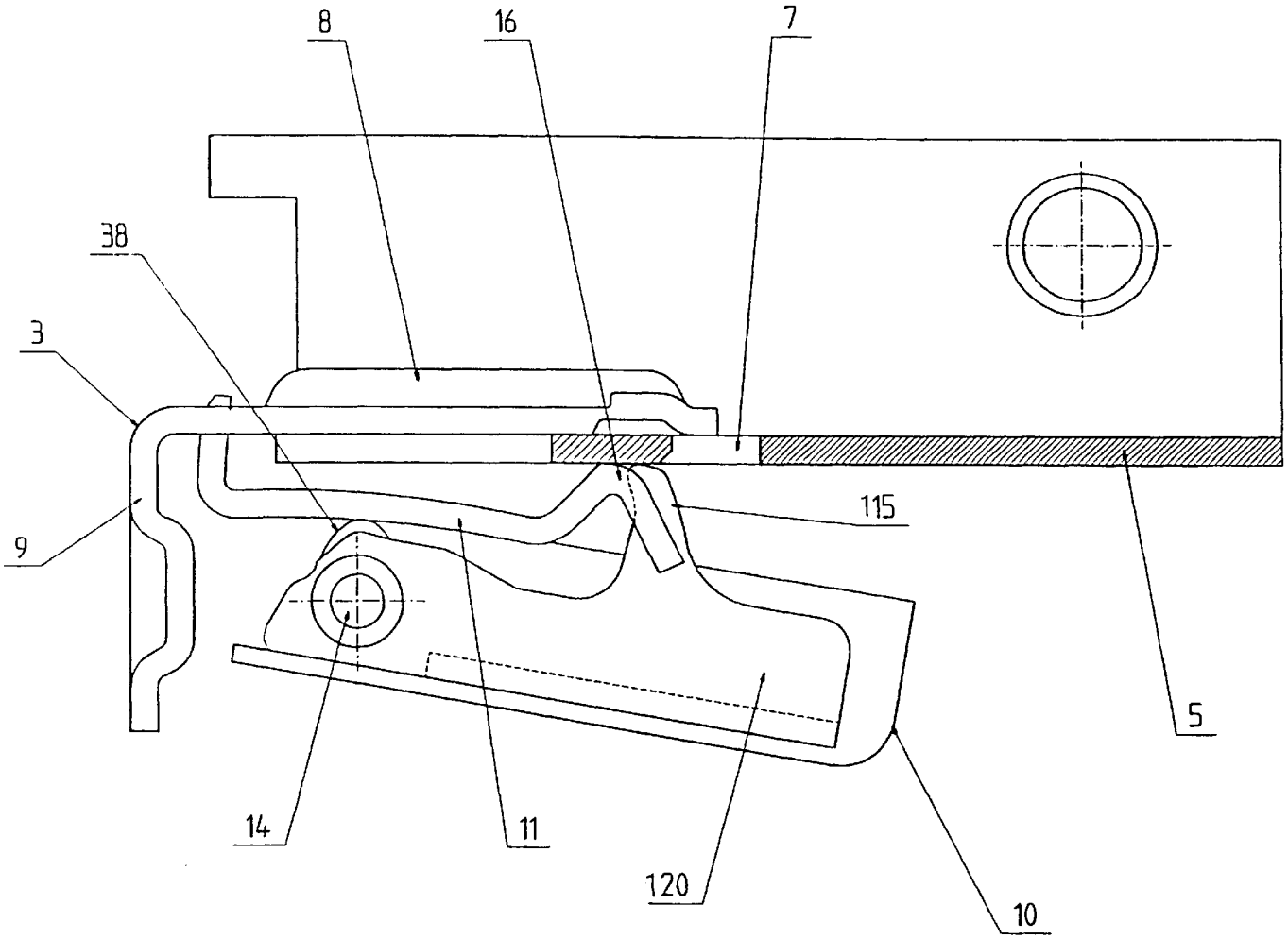
FIG. 38 is a horizontal sectional view of a drawer side wall and parts of the fastening device, whereby the fastening device is positioned incorrectly on the drawer side wall.
Figure 39:
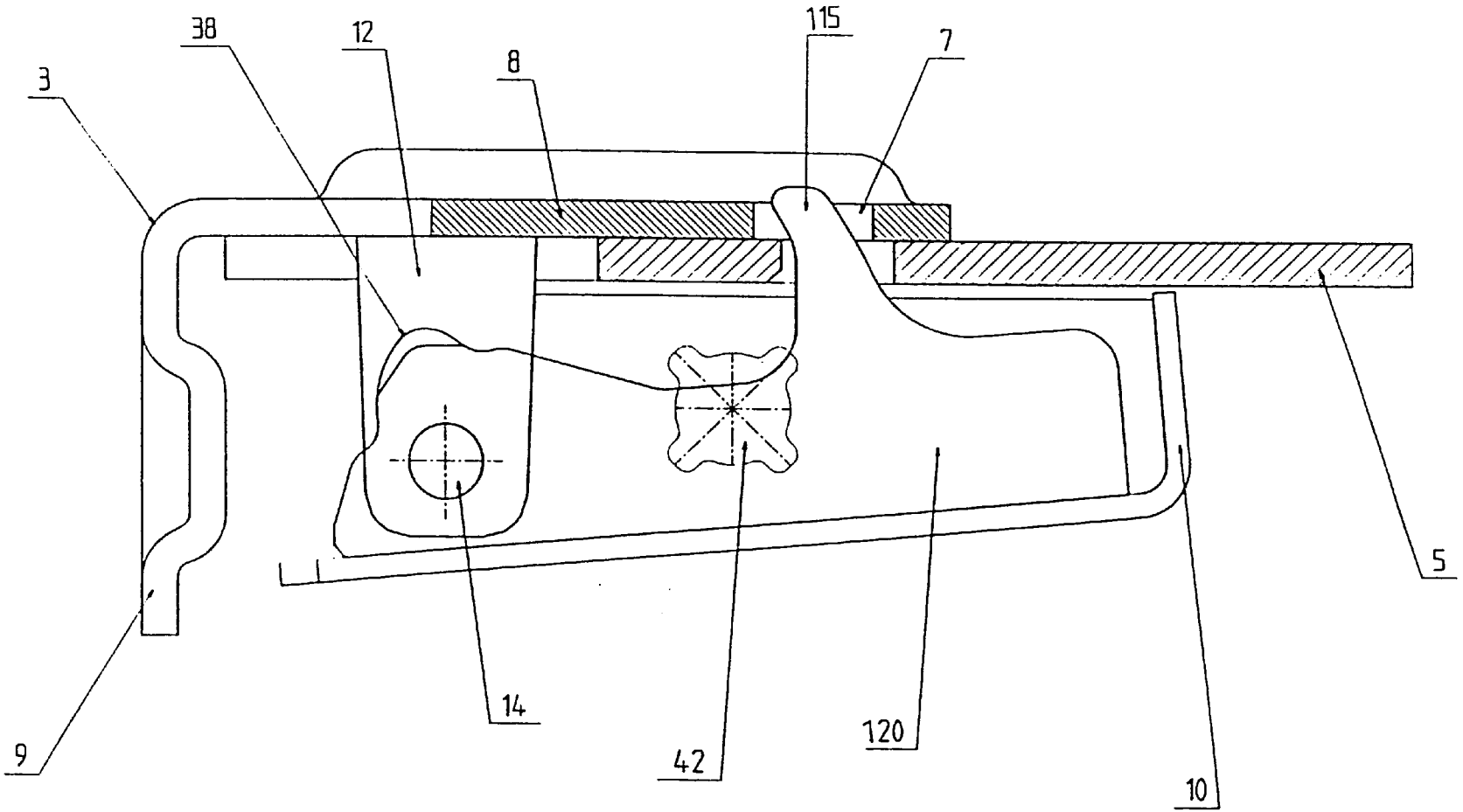
FIG. 39 is a horizontal sectional view of the front end of a drawer side wall showing the fastening device in the correct locking position.

If the fastening device 3 is not mounted correctly on the drawer side wall 5, which in most cases means it is not pushed far enough onto the drawer side wall 5, and the clamping lever 10 is tilted toward the locking position, the stop 115 cannot be moved into the opening 7 and abuts the vertical web of the drawer side wall 5 as shown in FIG. 38. Therefore, the lateral projection 16 in front of the opening 7, and tightening member 11 is only pressed toward the drawer side wall 5 without the projection 16 protruding into the opening 7. If the fastening device 3 is held on the drawer side wall 5 only by means of a clamping force acting on the vertical web of the drawer side wall 5, it could create the impression that the fastening device 3 and the front panel 4 are correctly mounted. However, it would be relatively easy to pull the front panel 4 and the fastening device 3 from the drawer side wall 5, whereby the tightening member 11 could be damaged.

The lateral webs 121, 122 of the control member 120 shown in FIG. 40 each have two web portions 121', 121" and 122', 122". The web portions 121', 122' are nearer to each other than the web portions 121", 122". The cams 38 are provided on the web portions 121', 122' and the stops 115 in the form of a hook are provided on the web portions 121", 122". Thus, when the clamping lever 10 is tilted into the locking position, the tightening member 11 is positioned between the web portions 121", 122" with the stops 115.

Figures 33, 34, 35:
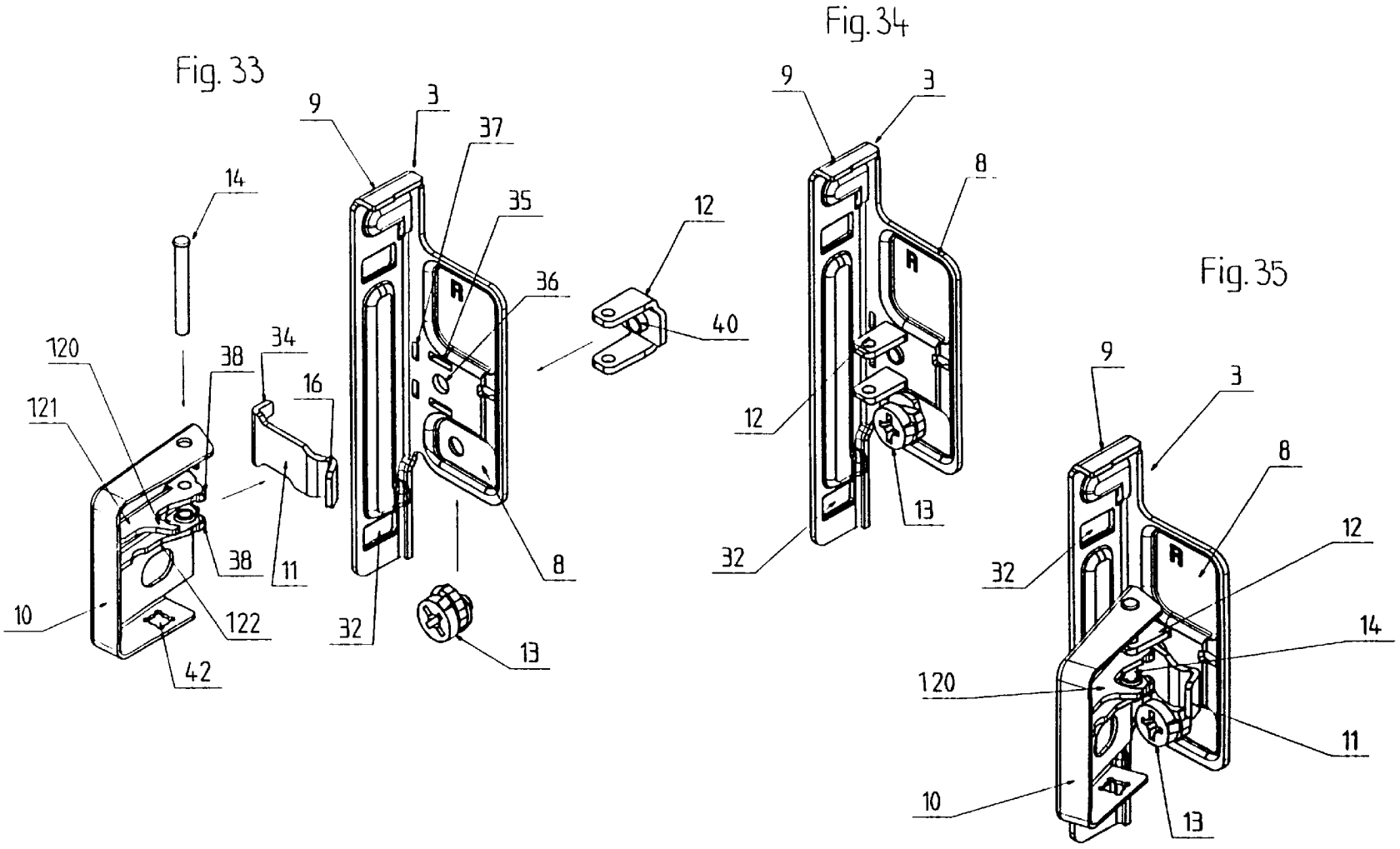
FIG. 33 is a perspective view of the fastening device in which the parts are shown separated.
FIG. 34 is a perspective view of the fastening device without the clamping lever.
FIG. 35 is a perspective view of the fastening device, the clamping lever being in the non-locking position.
Figure 37:
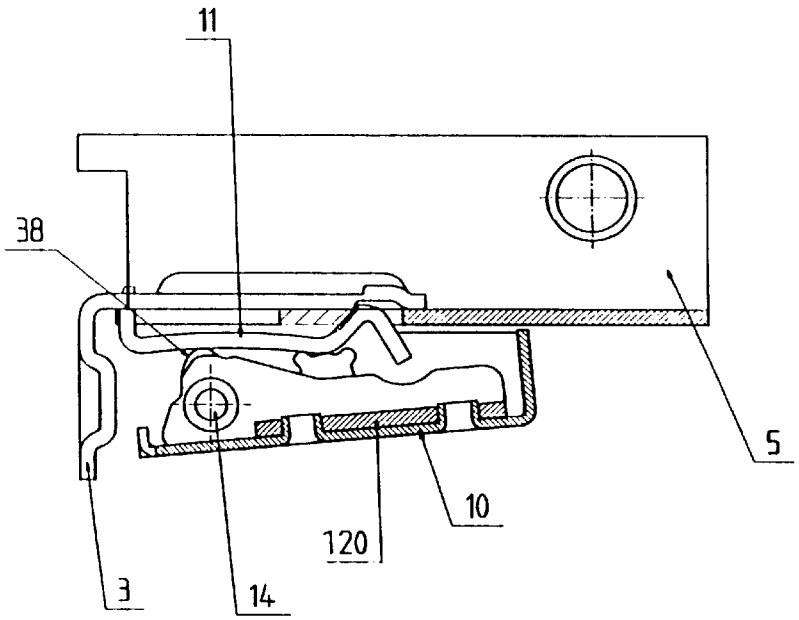
FIG. 37 is a horizontal sectional view similar to FIG. 36, whereby the clamping lever is shown in the locking position.
Figure 36:
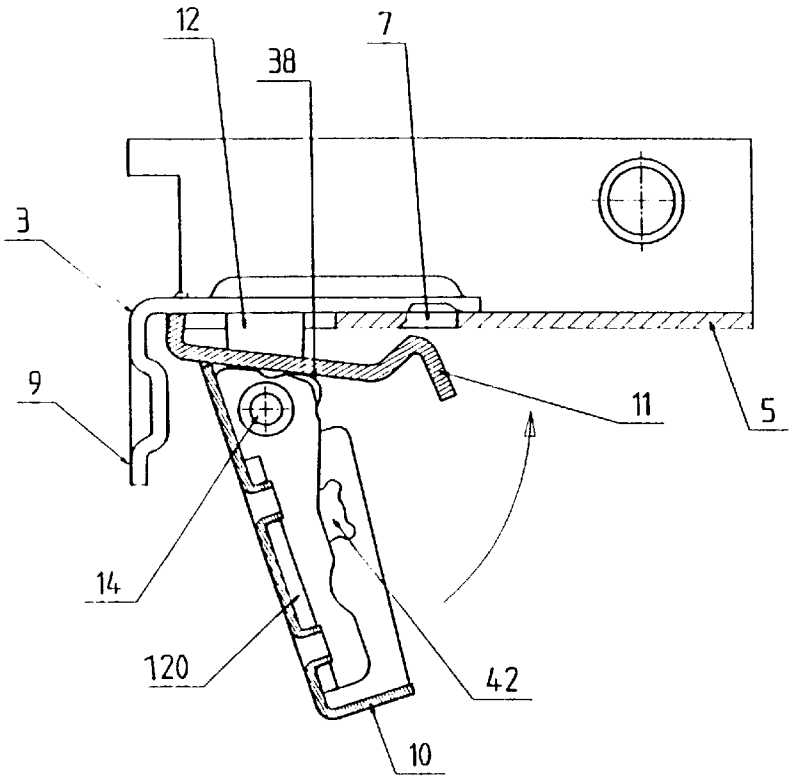
FIG. 36 is a horizontal sectional view of a drawer side wall and a fastening device with the clamping lever being in the non-locking position.
Figure 41:
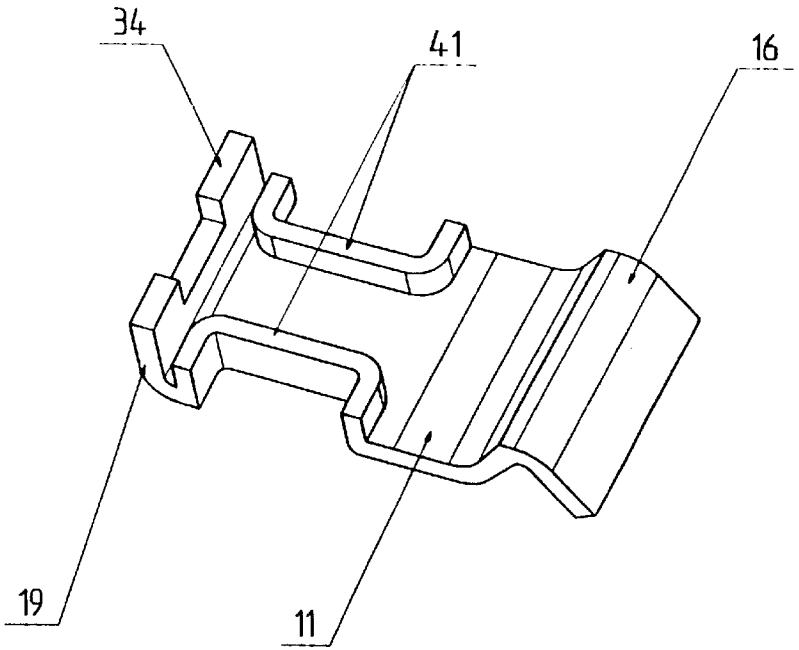
FIG. 41 is a perspective view of a tightening member.

The tightening member 11 can be made of spring steel as shown in FIG. 33. It can also be provided with rims 41 as shown in FIG. 41. The rims 41 constitute a reinforcement for the tightening member 11.

The clamping lever 10, which has the form of a cap, has an opening 42 in lateral rim thereof. By means of the opening 42 is possible to insert a tool, particularly a screw driver, underneath the clamping lever 10. By turning or tilting such screw driver the clamping lever 10 can be moved out of its locking position and the fastening device 3 can be moved from the drawer side wall 5.

To make the mounting of the fastening device 3 on the drawer side wall 5 easier, a spring element 43 can be provided as shown in FIGS. 42*a* to 44. Such a spring element 43 is mounted on the inner side of the fastening plate 8. In the embodiment shown, the spring element 43 is in the form of a block of plastic material having a flap 44. The flap 44 pushes the tightening member 11 toward the non locking position so that the drawer side wall 5 can easily be inserted between the fastening plate 8 and the tightening member 11. On the other hand, the spring force of the spring element 43 or the flap 44 is so weak that it is not noticed when the clamping lever 10 is moved into the locking position. Instead of a spring element made of plastic material, a leaf spring could be used.

We claim:

1. A fastening device for fastening a drawer front panel to a drawer side wall including a vertical web having therein an opening, said fastening device comprising:

a holding plate to be attached to the drawer front panel;

a fastening plate integral with said holding plate and extending therefrom in a direction to be perpendicular to the drawer front panel;

a clamping lever mounted on said fastening plate by an axle and pivotable about said axle relative to said fastening plate between an unlocking position whereat the drawer front panel can be removed from the drawer side wall and a locking position whereat the drawer front panel can be secured to the drawer side wall; and a tightening member having a projection, said tightening member being slideably mounted on said fastening plate and having a projection, said tightening member being positioned with respect to said fastening plate at a location to be between said clamping lever and the drawer side wall, and such that pivoting movement of said clamping lever from said unlocking position thereof to said locking position thereof moves said tightening member in a direction to be toward the drawer side wall wherein said projection is capable of moving into the opening in the drawer side wall.

2. A fastening device as claimed in claim 1, wherein said tightening member comprises a plate extending in a direction to be parallel to the vertical web of the drawer side wall.

3. A fastening device as claimed in claim 1, further comprising a holding element connecting said clamping lever to said fastening plate, said holding element extending through an opening in said tightening member.

4. A fastening device as claimed in claim 1, wherein said clamping lever is in the form of a cap covering said tightening member in said locking position of said clamping lever.

5. A fastening device as claimed in claim 1, wherein said projection has a wedge surface to abut an edge of the vertical web defining the opening therein.

6. A fastening device as claimed in claim 1, wherein said clamping lever has extending therefrom at least one lateral projection abutting said tightening member.

7. A fastening device as claimed in claim 1, wherein said tightening member has a lug having therein first and second slots, said tightening member is mounted on said axle, and said axle is positioned for sliding movement in said first slot, such that said first slot guides movement of said tightening member.

8. A fastening device as claimed in claim 7, further comprising a pin extending from said tightening member into said second slot, such that movement of said tightening member is guided by both said first and second slots.

9. A fastening device as claimed in claim 8, wherein said first and second slots extend rectilinearly, said first slot extends in a first direction to be parallel to the drawer side wall, and said second slot has a first portion extending in a second direction inclined to said first direction and a second portion parallel to said first direction.

10. A fastening device as claimed in claim 7, further comprising articulated levers connecting said clamping lever to said fastening plate.

11. A fastening device as claimed in claim 1, wherein said projection of said tightening member is hook-shaped.

12. A fastening device as claimed in claim 11, wherein said clamping lever includes at least one stop preventing pivoting movement of said clamping lever to said locking position thereof when said fastening device is oriented incorrectly with respect to the drawer side wall.

13. A fastening device as claimed in claim 12, wherein said at least one stop is hook-shaped and, when said fastening device is oriented correctly with respect to the drawer side wall, extends into the opening in the drawer side wall when said clamping lever is in said locking position.

14. A fastening device as claimed in claim 13, wherein said at least one stop is located at a position to be spaced from a front edge defining the opening when said clamping lever is in said locking position.

15. A fastening device as claimed in claim 12, wherein said clamping lever has lateral rims, and said at least one stop is provided on an intermediate rim positioned between said lateral rims and extending parallel thereto.

16. A fastening device as claimed in claim 15, wherein at least one of said lateral rims has an opening for insertion of a tool.

17. A fastening device as claimed in claim 12, wherein said at least one stop is provide on a control member having at least one cam pressing on said tightening member in said locking position of said clamping lever.

18. A fastening device as claimed in claim 17, wherein said cam moves over a dead center when said clamping lever is moved to said looking position.

19. A fastening device as claimed in claim 1, wherein said tightening member has at least one lateral guide web projecting through an opening in said tightening member.

20. A fastening device as claimed in claim 1, wherein said tightening member is formed of spring steel.

21. A fastening device as claimed in claim 1, further comprising a spring member mounted on said fastening plate and acting on said tightening member to urge said tightening member away from said fastening plate.

22. A drawer side wall including a vertical web having therein an opening, and a fastening device for fastening a drawer front panel to said drawer side wall, said fastening device comprising:

a holding plate to be attached to the drawer front panel;

a fastening plate integral with said holding plate and extending therefrom in a direction to be perpendicular to the drawer front panel;

a clamping lever mounted on said fastening plate by an axle and pivotable about said axle relative to said fastening plate between an unlocking position whereat the drawer front panel can be removed from said drawer side wall and a locking position whereat the drawer front panel is secured to said drawer side wall; and a tightening member having a projection, said tightening member being slideably mounted on said fastening plate and having a projection, said tightening member being positioned with respect to said fastening plate at a location to be between said clamping lever and said drawer side wall, and such that pivoting movement of said clamping lever from said unlocking position thereof to said locking position thereof moves said tightening member in a direction toward said drawer side wall until said projection moves into said opening in said drawer side wall.

23. A fastening device as claimed in claim 22, wherein said tightening member comprises a plate extending in a direction to be parallel to said vertical web of said drawer side wall.

24. A fastening device as claimed in claim 22, further comprising a holding element connecting said clamping lever to said fastening plate, said holding element extending through an opening in said tightening member.

25. A fastening device as claimed in claim 22, wherein said clamping lever is in the form of a cap covering said tightening member in said locking position of said clamping lever.

26. A fastening device as claimed in claim 22, wherein said projection has a wedge surface to abut an edge of said vertical web defining said opening therein.

27. A fastening device as claimed in claim 22, wherein said clamping lever has extending therefrom at least one lateral projection abutting said tightening member.

28. A fastening device as claimed in claim 27, further comprising articulated levers connecting said clamping lever to said fastening plate.

29. A fastening device as claimed in claims 22, wherein said tightening member has a lug having therein first and second slots, said tightening member is mounted on said axle, and said axle is positioned for sliding movement in said first slot, such that said first slot guides movement of said tightning member.

30. A fastening device as claimed in claim 29, further comprising a pin extending from said tightening member into said second slot, such that movement of said tightening member is guided by both said first and second slots.

31. A fastening device as claimed in claim 30, wherein said first and second slots extend rectilinearly, said first slot extends in a first direction to be parallel to said drawer side wall, and said second slot has a first portion extending in a second direction inclined to said first direction and a second portion parallel to said first direction.

32. A fastening device as claimed in claim 22, wherein said projection of said tightening member is hook-shaped.

33. A fastening device as claimed in claim 22, wherein said clamping lever includes at least one top preventing pivoting movement of said clamping lever to said locking position thereof when said fastening device is oriented incorrectly with respect to said drawer side wall.

34. A fastening device as claimed in claim 33, wherein said at least one stop is hook-shaped and, when said fastening device is oriented correctly with respect to said drawer side wall, extends into said opening in said drawer side wall when said clamping lever is in said locking position.

35. A fastening device as claimed in claim 34, wherein said at least one stop is located at a position to be spaced from a front edge defining said opening when said clamping lever is in said locking position.

36. A fastening device as claimed in claim 33, herein said clamping lever has lateral rims, and said at least one stop is provided on an intermediate rim positioned between said lateral rims and extending parallel thereto.

37. A fastening device as claimed in claim 36, wherein at least one of said lateral rims has an opening for insertion of a tool.

38. A fastening device as claimed in claim 33, wherein said at least one stop is provide on a control member having at least one cam pressing on said tightening member in said locking position of said clamping lever.

39. A fastening device as claimed in claim 38, wherein said cam moves over a dead center when said clamping lever is moved to said locking position.

40. A fastening device as claimed in claim 22, wherein said tightening member has at least one lateral guide web projecting through an opening in said tightening member.

41. A fastening device as claimed in claim 22, wherein said tightening member is formed of spring steel.

42. A fastening device as claimed in claim 22, further comprising a spring member mounted on said fastening plate and acting on said tightening member to urge said tightening member away from said fastening plate.

* * * * *